US007600866B2

(12) United States Patent
Takeshita et al.

(10) Patent No.: US 7,600,866 B2
(45) Date of Patent: Oct. 13, 2009

(54) TRAY AND RECORDING APPARATUS

(75) Inventors: Sanshiro Takeshita, Nagano (JP); Eiichi Miyashita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 664 days.

(21) Appl. No.: 11/396,171

(22) Filed: Mar. 31, 2006

(65) Prior Publication Data

US 2006/0243644 A1 Nov. 2, 2006

(30) Foreign Application Priority Data

Mar. 31, 2005 (JP) ..... P2005-101522
Aug. 26, 2005 (JP) ..... P2005-245912

(51) Int. Cl.
*B41J 2/01* (2006.01)

(52) U.S. Cl. ..... 347/101

(58) Field of Classification Search ..... 347/101, 347/104, 105, 16; 400/23, 27–30, 48, 55–56, 400/61, 342
See application file for complete search history.

(56) References Cited

U.S. PATENT DOCUMENTS 6,871,946 B2 3/2005 Yanagi et al.
7,073,880 B2 * 7/2006 Takahashi et al. ..... 347/16
7,325,898 B2 * 2/2008 Kawazoe et al. ..... 347/19

FOREIGN PATENT DOCUMENTS

CN 1495036 A 5/2004
JP 2002-127530 5/2002

* cited by examiner

*Primary Examiner*—Lamson D Nguyen
(74) *Attorney, Agent, or Firm*—Nutter McClennen & Fish LLP; John J. Penny, Jr.

(57) ABSTRACT

A tray adapted to be loaded in a recording apparatus which comprises a transport roller transporting a medium in a first direction, a recording head moved in a second direction orthogonal to the first direction to record information on the medium, and a sensor, the tray comprising: a tray body, adapted to be transported in the first direction by the transport roller to a region opposing to the recording head; a set portion, adapted such that the medium is placed thereon; a first boundary line, defining two regions having different reflectivities and orthogonal to the second direction, the first boundary line being adapted to be detected by the sensor to provide a first reference position relative to the second direction; and a second boundary line, defining two regions having different reflectivities and orthogonal to the first direction, the second boundary line being adapted to be detected by the sensor to provide a second reference position relative to the first direction.

11 Claims, 15 Drawing Sheets

TRAY AND RECORDING APPARATUS

BACKGROUND OF THE INVENTION

1. Technical Field of the Invention

The present invention relates to a tray capable of setting a thin plate-shaped member which is represented by an optical disk. Moreover, the invention relates to a recording apparatus constituted to transport a tray capable of setting a thin plate-shaped member represented by an optical disk.

2. Description of the Related Art

An ink jet printer according to an example of a recording apparatus has such a structure that an ink droplet is directly discharged to a label surface of an optical disc to be a thin plate-shaped member which is represented by a compact disc or a DVD (Digital Versatile Disc), thereby carrying out recording. In such an ink jet printer, generally, the thin plate-shaped member such as the optical disc is set to a tray having a plate shape and is transported (a secondary scanning feed) through a transport path in the ink jet printer in a setting state to the tray, and recording is thus executed.

There has conventionally been proposed a method of detecting a central position of an optical disc (a reference position for printing) in order to carry out the printing over a label surface (printing region) of the optical disc with high precision in such a manner that a shift in a printing position is not caused. As an example, JP-A-2002-127530 has disclosed a method of providing an identification mark on a tray and disposing an optical sensor in a bottom part of a carriage to be reciprocally driven in a primary scanning direction, that is, an opposed portion to the tray to sense the identification mark by means of the sensor, thereby obtaining the central position of the optical disc.

In the method described in JP-A-2002-127530, however, the whole optical disc is sensed in the primary scanning direction by means of the optical sensor, and subsequently, the whole optical disc is sensed in the secondary scanning direction in the same manner. For this reason, an amount of a movement of the carriage and an amount of a secondary scanning feed of the tray in the acquirement of the central position are increased. Accordingly, a long time is required for the sensing.

Moreover, the tray is apt to generate a slip together with the transport roller in the secondary scanning feed. Accordingly, it is preferable that the amount of the secondary scanning feed of the tray in the sensing should be smaller in order to enhance precision in the detection of the central position. Furthermore, it is preferable that the amount of the movement of the carriage should also be smaller in order to enhance the precision in the detection.

SUMMARY OF THE INVENTION

Therefore, the invention has been made in consideration of such situations and has an object to shorten a time required for sensing through an optical sensor when obtaining a reference position of a medium which is set to a tray, and furthermore, to enhance precision in the detection of the reference position still more.

In order to solve the problems, a first aspect of the invention is directed to a tray comprising a tray body taking a shape of a plate which can be subjected to a secondary scanning feed by means of a transport roller for transporting a medium to an opposed region to a recording head for carrying out recording to the medium, and a set portion formed in the tray body and capable of setting a thin plate-shaped member as the medium, wherein the set portion is provided with a fitting portion for fitting in a fitting hole formed on the medium, and the fitting portion is provided with a first detected line which is formed by a boundary line between regions having different reflectivities and is orthogonal to a primary scanning direction, and a second detected line which is formed by a boundary line between regions having different reflectivities and is orthogonal to the secondary scanning direction.

According to the aspect, the first detected line and the second detected line are orthogonal to the primary scanning direction and the secondary scanning direction, respectively. By previously obtaining a distance between a reference position (hereinafter referred to as a "reference position $x_c$") in the primary scanning direction in the execution of recording and the first detected line and a distance between a reference position (hereinafter referred to as a "reference position $y_c$") in the secondary scanning direction in the execution of the recording and the second detected line, therefore, it is possible to acquire the reference position $x_c$ even if any place in the first detected line is sensed, and to acquire the reference position $y_c$ even if any place in the second detected line is sensed. In other words, the first detected line and the second detected line are orthogonal to the primary scanning direction and the secondary scanning direction, respectively. When the reference position $x_c$ and the reference position $y_c$ are to be obtained, therefore, it is sufficient that the first detected line and the second detected line are detected. Consequently, it is possible to shorten a time required for the sensing.

Moreover, it is sufficient that the amount of the secondary scanning feed of the tray in the detection of the second detected line is also small. Therefore, it is possible to reduce or prevent a deterioration in precision of the detection of the reference position $y_c$ due to the generation of a slip between the transport roller for transporting the tray and the tray.

In particular, a trace line of the sensor in the detection of the first detected line and the second detected line through the sensor can be prevented from crossing the fitting portion, and furthermore, can consecutively cross the second detected line or the first detected line without getting out of the fitting portion after crossing the first detected line (or the second detected line). Therefore, a very small amount of the secondary scanning feed of the tray is enough when the reference position $y_c$ is to be obtained. Consequently, it is possible to prevent a deterioration in the precision in the detection of the reference position $y_c$ still more reliably, and furthermore, to greatly shorten the time required for the sensing when obtaining the reference position $x_c$ and the reference position $y_c$.

A second aspect of the invention is directed to the tray according to the first aspect, wherein the set portion takes a symmetrical shape with respect to the primary scanning direction and the secondary scanning direction and the fitting portion is provided in a central position in the primary scanning direction and the secondary scanning direction of the set portion.

According to the aspect, the set portion takes a symmetrical shape with respect to the primary scanning direction and the secondary scanning direction, and furthermore, the fitting portion is provided in the central position in the primary scanning direction and the secondary scanning direction of the set portion. When setting the reference position $x_c$ and the reference position $y_c$ to be the central positions of the medium, therefore, it is possible to obtain the functions and advantages according to the first aspect.

A third aspect of the invention is directed to the tray according to the first or second aspect, wherein each of the first detected line and the second detected line is a side constituting one plane figure.

According to the aspect, in the first or second aspect, each of the first detected line and the second detected line is the side constituting the plane figure. Therefore, it is possible to easily form the first detected line and the second detected line at a low cost.

A fourth aspect of the invention is directed to the tray according to the third aspect, wherein the plane figure is a right triangle.

According to the aspect, the plane figure is a right triangle. Therefore, the plane figure can be set to have a necessary minimum area and the degree of freedom of the arrangement of the plane figure in the fitting portion can be enhanced. In the case in which the plane figure is to be formed by a hole, furthermore, it is possible to prevent a reduction in a strength of the fitting portion.

A fifth aspect of the invention is directed to the tray according to the third aspect, wherein the plane figure further has a third detected line which is formed by a boundary line between regions having different reflectivities and is orthogonal to the primary scanning direction.

According to the aspect, the plane figure further has the third detected line which is formed by the boundary line between the regions having different reflectivities and is orthogonal to the primary scanning direction. When sensing the optical sensor in the primary scanning direction, therefore, it is possible to carry out the sensing by using any of the detected lines which is placed on a closer side (the first detected line or the third detected line) even if the sensor is provided on any side with respect to the fitting portion, to further shorten the time required for the sensing, and furthermore, to enhance the degree of freedom of a control.

A sixth aspect of the invention is directed to the tray according to the fifth aspect, further comprising a fourth detected line which is formed by a boundary line between regions having different reflectivities and is orthogonal to the secondary scanning direction.

According to the aspect, the plane figure further has the fourth detected line which is formed by the boundary line between the regions having different reflectivities and is orthogonal to the secondary scanning direction. When sensing the optical sensor in the secondary scanning direction, therefore, it is possible to carry out the sensing by using any of the detected lines which is placed on a closer side (the second detected line or the fourth detected line) even if the sensor is provided on any side with respect to the fitting portion, to further shorten the time required for the sensing, and furthermore, to enhance the degree of freedom of a control.

A seventh aspect of the invention is directed to the tray according to the fifth or sixth aspect, wherein the plane figure is a square.

According to the aspect, the plane figure is the square. Even if any of the detected lines which constitute the square is used, therefore, it is possible to obtain the reference position $x_c$ and the reference position $y_c$, to further shorten the time required for the sensing, and furthermore, to enhance the degree of freedom of a control.

An eighth aspect of the invention is directed to a tray comprising a tray body taking a shape of a plate which can be subjected to a secondary scanning feed by means of a transport roller for transporting a medium to an opposed region to a recording head for carrying out recording to the medium, and a set portion formed in the tray body and capable of setting a thin plate-shaped member as the medium, wherein the thin plate-shaped member takes a shape of a disk and the set portion takes a circular shape, the tray body is provided with a first detected line which is formed by a boundary line between regions having different reflectivities and is orthogonal to a primary scanning direction, and a second detected line which is formed by a boundary line between regions having different reflectivities and is orthogonal to a secondary scanning direction, each of the first detected line and the second detected line is a side constituting one plane figure, and the plane figure is disposed on an outside of the set portion, and a position thereof is set away from a central position in the primary scanning direction and a central position in the secondary scanning direction of the set portion within a range of formation of the set portion in the primary scanning direction and/or the range of the formation of the set portion in the secondary scanning direction.

According to the aspect, the same functions and advantages as those in the first and third aspects can be obtained. In addition, in the case in which the plane figure is disposed on the outside of the set portion, the residual space which is adjacent to the set portion taking a circular shape is used. In the case in which the plane figure is disposed on the outside of the set portion, therefore, it is not necessary to increase the size of the tray for disposing the plane figure.

A ninth aspect of the invention is directed to a tray comprising a tray body taking a shape of a plate which can be subjected to a secondary scanning feed by means of a transport roller for transporting a medium to an opposed region to a recording head for carrying out recording to the medium, and a set portion formed in the tray body and capable of setting a thin plate-shaped member as the medium, wherein the thin plate-shaped member takes a shape of a disk and the set portion takes a circular shape, the tray body is provided with a first detected line which is formed by a boundary line between regions having different reflectivities and is orthogonal to a primary scanning direction, and a second detected line which is formed by a boundary line between regions having different reflectivities and is orthogonal to a secondary scanning direction, each of the first detected line and the second detected line is a side constituting one plane figure, and the plane figure is disposed on an outside of the set portion, and is positioned on a center in the main scanning direction or a center in the secondary scanning direction of the set portion.

According to the aspect, the same functions and advantages as those in the first and third aspects can be obtained. In addition, in the case in which the plane figure is disposed on the outside of the set portion, it is provided on the center in the primary scanning direction or the center in the secondary scanning direction of the set portion. In the case in which the reference position $x_c$ and the reference position $y_c$ are set to be the center of the set portion, therefore, a distance between the first detected line and the reference position $x_c$ is reduced if the plane figure is disposed on the center in the primary scanning direction of the set portion or a distance between the second detected line and the reference position $y_c$ is reduced if the plane figure is disposed on the center in the secondary scanning direction of the set portion. Consequently, it is possible to prevent a deterioration in the precision in the detection of the reference position $x_c$ or the reference position $y_c$.

A tenth aspect of the invention is directed to a recording apparatus comprising a carriage including a recording head for carrying out recording to a medium, a motor for the carriage which drives the carriage, a sensor provided in an opposed position to the medium in the carriage and serving to detect a difference in a reflectivity of the medium, a transport roller constituted to include a transport driving roller which is rotated and driven to nip and rotate a medium to be transported, thereby transporting the medium to be transported to the recording head, and a transport driven roller driven and rotated in pressure contact with the transport driving roller, a motor for the transport driving roller which serves to rotate and drive the transport driving roller, and a control portion for controlling the motor for the carriage and the motor for the transport driving roller, and having such a structure that a tray constituted to include a tray body taking a shape of a plate and a set portion formed in the tray body and capable of setting a thin plate-shaped member which is the medium can be transported by means of the transport roller, wherein the tray body is provided with a first detected line which is formed by a boundary line between regions having different reflectivities and intersects a primary scanning direction, and a second detected line which is formed by a boundary line between regions having different reflectivities and intersects a secondary scanning direction, each of the first detected line and the second detected line constitutes one plane figure, and the control portion controls the motor for the transport driving roller and the motor for the carriage, thereby forming a trace line in which the sensor crosses the first detected line and a trace line in which the sensor crosses the second detected line.

According to the aspect, each of the first detected line and the second detected line constitutes the plane figure, and the control portion controls the motor for the transport driving roller and the motor for the carriage, thereby forming the trace line in which the sensor crosses the first detected line and the trace line in which the sensor crosses the second detected line. Consequently, it is sufficient that the amount of the movement of the carriage and the amount of the secondary scanning feed of the tray in the acquirement of the reference positions $x_c$ and $y_c$ are very small. The deterioration in the precision of the detection of the reference positions $x_c$ and $y_c$ can be prevented still more reliably, and furthermore, the time required for the sensing can be shortened considerably.

An eleventh aspect of the invention is directed to a recording apparatus comprising a carriage including a recording head for carrying out recording to a medium, a motor for the carriage which drives the carriage, a sensor provided in an opposed position to the medium in the carriage and serving to detect a difference in a reflectivity of the medium, a transport roller constituted to include a transport driving roller which is rotated and driven to nip and rotate a medium to be transported, thereby transporting the medium to be transported to the recording head, and a transport driven roller driven and rotated in pressure contact with the transport driving roller, a motor for the transport driving roller which serves to rotate and drive the transport driving roller, and a control portion for controlling the motor for the carriage and the motor for the transport driving roller, and having such a structure that a tray constituted to include a tray body taking a shape of a plate and a set portion formed in the tray body and capable of setting a thin plate-shaped member which is the medium can be transported by means of the transport roller, wherein the set portion is provided with a fitting portion for fitting in a fitting hole formed on the medium, the fitting portion is provided with a first detected line which is formed by a boundary line between regions having different reflectivities and is orthogonal to a primary scanning direction, and a second detected line which is formed by a boundary line between regions having different reflectivities and is orthogonal to a secondary scanning direction, and the control portion controls the motor for the transport driving roller and the motor for the carriage in such a manner that a trace line of the sensor in detection of the first detected line through the sensor does not cross the fitting portion but the first detected line in the primary scanning direction and a trace line of the sensor in detection of the second detected line through the sensor does not cross the fitting portion but the second detected line in the secondary scanning direction.

According to the aspect, the motor for the transport driving roller and the motor for the carriage are controlled in such a manner that the trace line of the sensor in the detection of the first detected line through the sensor does not cross the fitting portion. Consequently, it is sufficient that the amount of the movement of the carriage and the amount of the secondary scanning feed of the tray in the acquirement of the reference positions $x_c$ and $y_c$ are very small. The deterioration in the precision of the detection of the reference positions $x_c$ and $y_c$ can be prevented still more reliably, and furthermore, the time required for the sensing can be shortened considerably.

A twelfth aspect of the invention is directed to a recording apparatus comprising a carriage including a recording head for carrying out recording to a medium, a motor for the carriage which drives the carriage, a sensor provided in an opposed position to the medium in the carriage and serving to detect a difference in a reflectivity of the medium, a transport roller constituted to include a transport driving roller which is rotated and driven to nip and rotate a medium to be transported, thereby transporting the medium to be transported to the recording head, and a transport driven roller driven and rotated in pressure contact with the transport driving roller, a motor for the transport driving roller which serves to rotate and drive the transport driving roller, and a control portion for controlling the motor for the carriage and the motor for the transport driving roller, and having such a structure that a tray constituted to include a tray body taking a shape of a plate and a set portion formed in the tray body and capable of setting a thin plate-shaped member which is the medium can be transported by means of the transport roller, wherein the set portion is provided with a fitting portion for fitting in a fitting hole formed on the medium, the fitting portion is provided with a first detected line which is formed by a boundary line between regions having different reflectivities and is orthogonal to a primary scanning direction, and a second detected line which is formed by a boundary line between regions having different reflectivities and is orthogonal to a secondary scanning direction, and the control portion controls the motor for the transport driving roller and the motor for the carriage in such a manner that a trace line of the sensor in detection of the first detected line and the second detected line through the sensor crosses the first detected line and subsequently crosses the second detected line without getting out of the fitting portion or crosses the second detected line and subsequently crosses the first detected line without getting out of the fitting portion.

According to the aspect, the control portion controls the motor for the transport driving roller and the motor for the carriage in such a manner that the trace line of the sensor in the detection of the first detected line and the second detected line through the sensor crosses the first detected line and then crosses the second detected line without getting out of the fitting portion or crosses the second detected line and subsequently crosses the first detected line without getting out of the fitting portion. Consequently, it is sufficient that the amount of the movement of the carriage and the amount of the secondary scanning feed of the tray in the acquirement of the reference positions $x_c$ and $y_c$ are very small. The deterioration in the precision of the detection of the reference positions $x_c$ and $y_c$ can be prevented still more reliably, and furthermore, the time required for the sensing can be shortened considerably.

A thirteenth aspect of the invention is directed to the recording apparatus according to any of the tenth to twelfth aspects, wherein the first detected line is orthogonal to the primary scanning direction, the second detected line is orthogonal to the secondary scanning direction, and the sensor detects the first detected line which is orthogonal to the primary scanning direction and the second detected line which is orthogonal to the secondary scanning direction.

According to the aspect, the first detected line is orthogonal to the primary scanning direction and the second detected line is orthogonal to the secondary scanning direction. Therefore, the first detected line and the second detected line can be detected easily and reliably.

A fourteenth aspect of the invention is directed to the recording apparatus according to any of the tenth to thirteenth aspects, wherein a reference position in execution of recording is calculated based on a result of the detection of the first detected line and the second detected line.

According to the aspect, the reference position in the execution of the recording can be obtained accurately in a short time.

A fifteenth aspect of the invention is directed to the recording apparatus according to the fourteenth aspect, wherein the medium takes a symmetrical shape in the primary scanning direction and the secondary scanning direction, and the reference position is a central position in the primary scanning direction and the secondary scanning direction of the medium.

According to the aspect, in the case in which the reference position in the execution of the recording is set to be the central position of the medium, the central position can be obtained accurately in a short time.

DETAILED DESCRIPTION OF THE INVENTION

Figure 1:
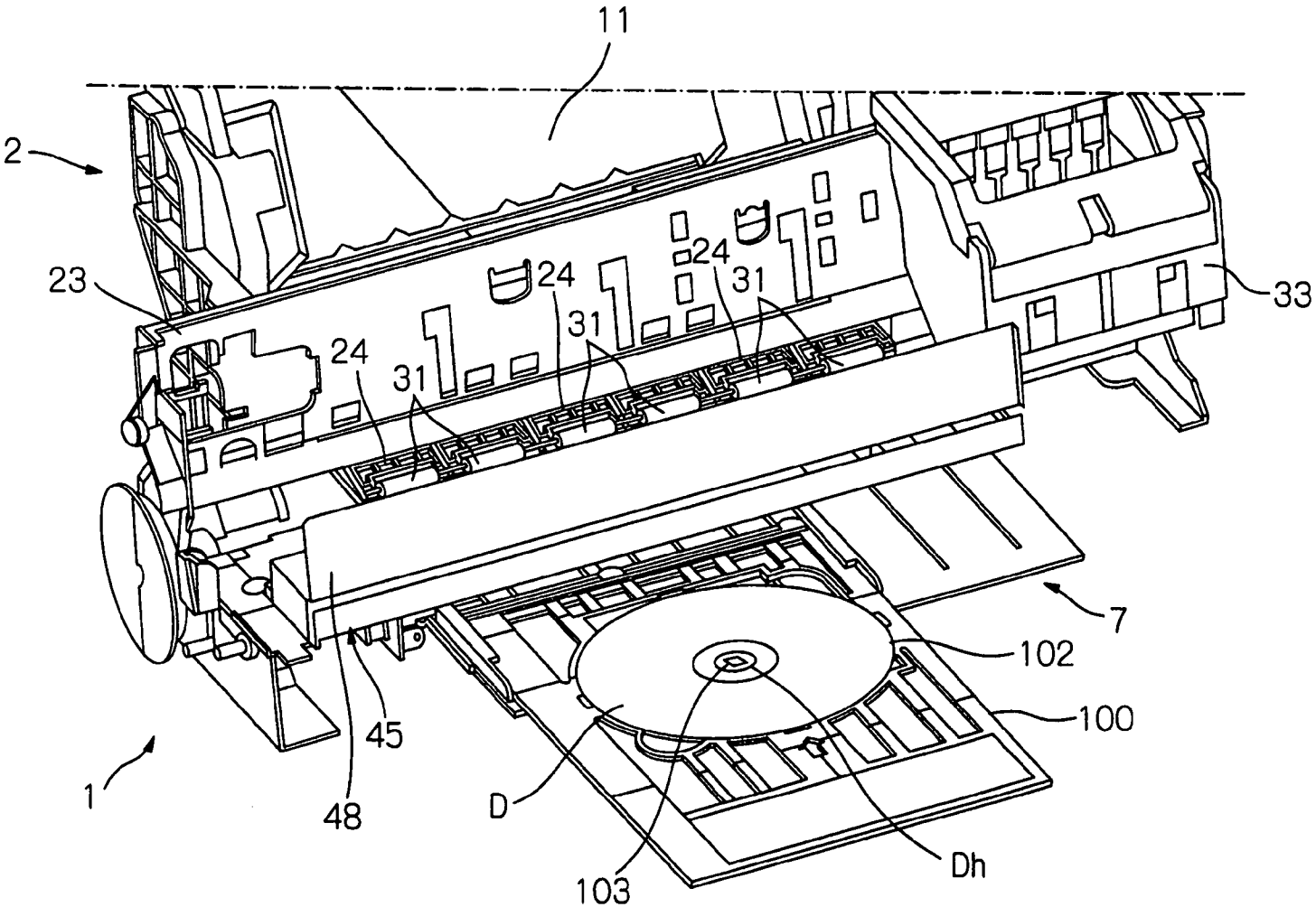
FIG. 1 is a perspective view showing an appearance of an apparatus body of a printer according to an embodiment of the invention.
Figure 2:
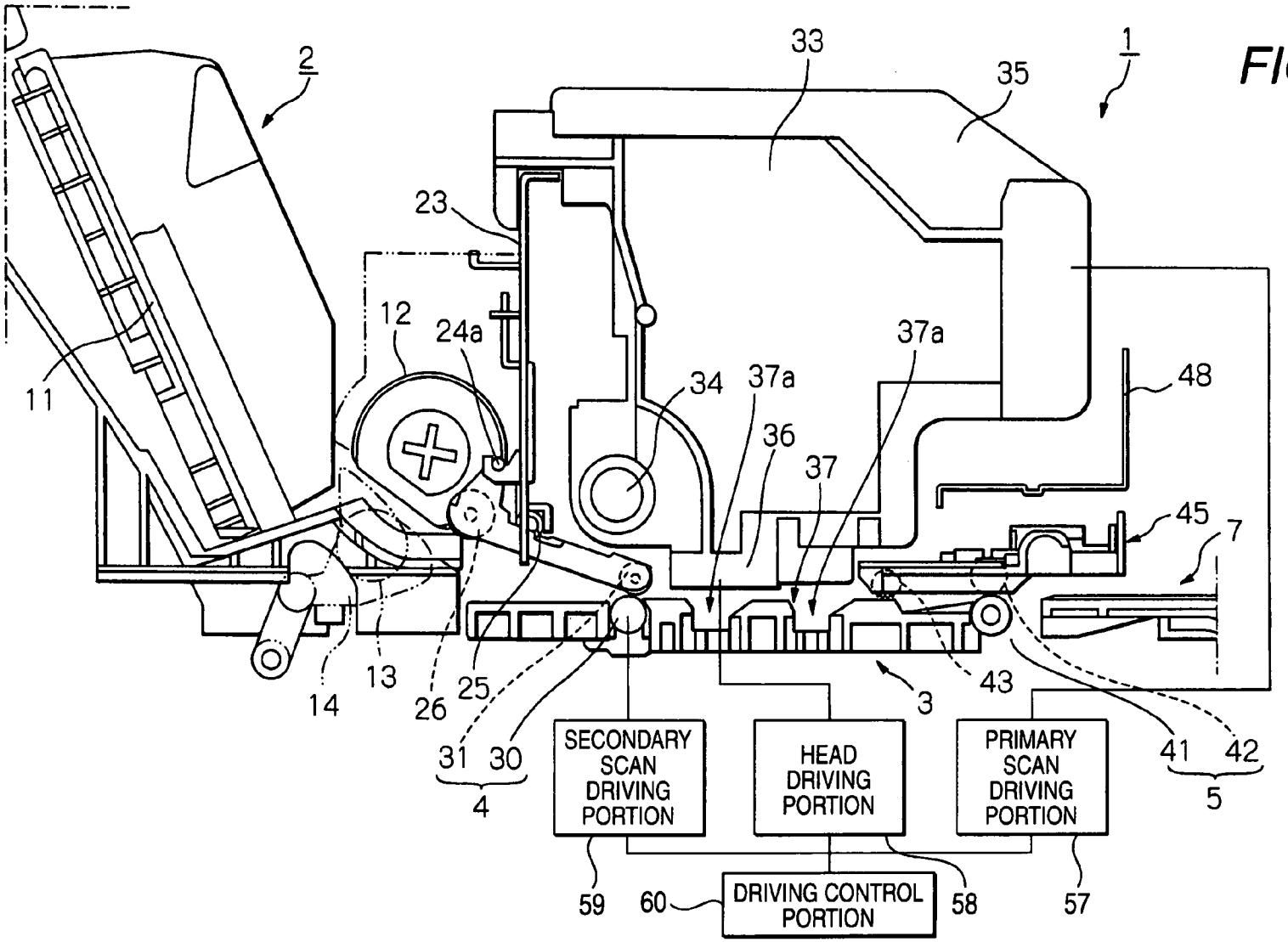
FIG. 2 is a sectional side view showing the printer according to the embodiment of the invention.
Figure 3:
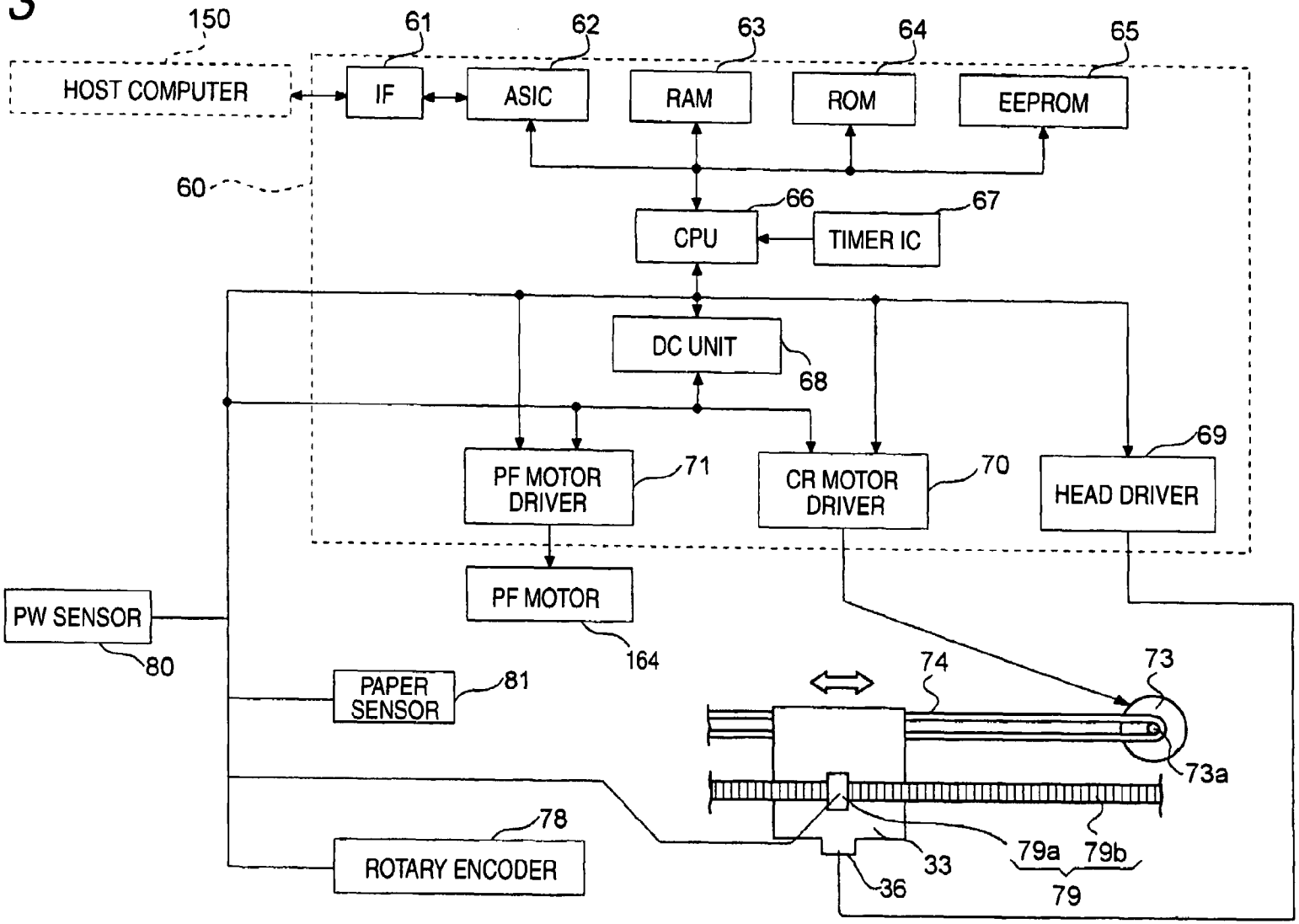
FIG. 3 is a block diagram showing a control portion of the printer recording to the embodiment of the invention.

An embodiment of the invention will be described below with reference to the drawings. With reference to FIGS. 1 and 2, description will be given to the summary of an ink jet printer (hereinafter referred to as a "printer") 1 as an example of a recording apparatus according to the invention. FIG. 1 is a perspective view showing an appearance of an apparatus body of the printer 1 (a state in which an exterior case is removed), FIG. 2 is a sectional side view showing the same, and FIG. 3 is a block diagram mainly showing a driving control portion 60. In the following, a rightward direction (a forward side of the printer) and a leftward direction (a rearward side of the printer) in FIG. 2 will be referred to as a "downstream side" and an "upstream side" of a transport path for a paper or a tray, respectively.

The printer 1 comprises, in a rear part, a feeding device 2 capable of setting a recording paper (mainly, a cut-form paper which will be hereinafter referred to as a "paper P") according to an example of a "medium to be recorded" and a "medium to be ejected" in an inclination posture, and feeds the paper P from the feeding device 2 toward a transport roller 4 on the downstream side. The paper P thus fed is transported to recording means 3 on the downstream side by means of the transport roller 4 so that recording is executed. The transport roller 4 also transports a tray 100 which will be described below, and the recording means 3 executes the recording to a label surface of an optical disc D to be a thin plate-shaped member (a medium) set to the tray 100. The paper P or the optical disc D (the tray 100) subjected to the recording by the recording means 3 is discharged to a forward part of the apparatus by means of a discharge roller 5 on the downstream side.

Components provided on a paper transport path of the printer 1 will be described below in more detail. The feeding device 2 is constituted to include a hopper 11, a feed roller 12, a retard roller 13 and a return lever 14.

The hopper 11 is formed by a plate-shaped member and is constituted rotatably around a rotation fulcrum (not shown) in an upper part, and is rotated to cause the paper P supported on the hopper 11 in the inclination posture to come in pressure contact with the feed roller 12 or to separate from the feed roller 12. The feed roller 12 takes a shape of almost D seen from a side and feeds, to the downstream side, the paper P in an uppermost part which comes in pressure contact through a circular arc portion thereof, while it is controlled in such a manner that a flat portion thereof is opposed to the paper P as shown in order not to generate a transport load during the tranport of the paper P through the transport roller 4 after the paper P is fed.

The retard roller 13 is provided to freely come in pressure contact with the circular arc portion of the feed roller 12. The retard roller 13 is driven and rotated (clockwise in FIG. 2) in contact with the paper P when the overlapping feed of the paper P is not generated but only one paper P is fed, and is brought into a stop state without a rotation because a coefficient of friction between the papers is lower than that between the paper P and the retard roller 13 when a plurality of papers P is present between the feed roller 12 and the retard roller 13. Accordingly, succeeding papers P to be fed with an overlap together with the uppermost paper P to be fed are not moved from the retard roller 13 toward the downstream side so that the overlapping feed can be prevented. The return lever 14 is provided rotatably and has the function of returning the succeeding papers P to be fed with an overlap onto the hopper 11.

A paper sensor 81 (FIG. 3) for detecting the passage of the paper P and a guide roller 26 for forming a feeding posture of the paper P and preventing the contact of the paper P with the feed roller 12 to relieve the transport load are provided between the feeding device 2 and the transport roller 4. In the embodiment, the guide roller 26 is supported pivotally so as to be freely rotatable at an end on an upstream side of an upper paper guide 24.

The transport roller 4 provided on the downstream side of the feeding device 2 is constituted to include a transport driving roller 30 to be rotated and driven by means of a motor and a transport driven roller 31 to be driven and rotated in pressure contact with the transport driving roller 30. The transport driving roller 30 is formed to include a sticking layer obtained by dispersing a wear-resistant particle almost uniformly into an outer peripheral surface of a metal shaft extended in a direction of a width of the paper, and a plurality of transport driven rollers 31 having outer peripheral surfaces formed by a material having a low friction such as elastomer is disposed in an axial direction of the transport driving roller 30.

Moreover, two transport driven rollers 31 are supported pivotally at an end on the downstream side of one upper paper guide 24 so as to be freely rotatable in the embodiment, and three upper paper guides 24 are provided in the direction of the width of the paper as shown in FIG. 1. Furthermore, the upper paper guide 24 has a shaft 24*a* supported pivotally on a main frame 23 so that it is provided to be rockable around the shaft 24*a* through the paper transport path seen from a side, and furthermore, is energized by means of a coiled spring 25 in such a direction that the transport driven roller 31 comes in pressure contact with the transport driving roller 30.

Moreover, the transport driving roller 31 is rotated and driven by means of a secondary scan driving portion 59. More specifically, the secondary scan driving portion 59 executes the secondary scanning feed of the paper P (and the tray 100 which will be described below).

The paper P reaching the transport roller 4 is transported in a nipping state between the transport driving roller 30 and the transport driven roller 31 to the recording means 3 on the downstream side by the rotation of the transport driving roller 30. Moreover, the tray 100 which will be described below is also transported in the nipping state between the transport driving roller 30 and the transport driven roller 31 to the recording means 3 on the downstream side by the rotation of the transport driving roller 30.

The recording means 3 is constituted to include an ink jet recording head (hereinafter referred to as a "recording head") 36 and a lower paper guide 37 provided opposite to the recording head 36. The recording head 36 is provided in a bottom part of a carriage 33, and the carriage 33 is provided to be guided by means of a carriage guide shaft 34 extended in a primary scanning direction (a double-sided direction of a paper in FIG. 2), and furthermore, is reciprocated in the primary scanning direction by means of a primary scan driving portion 57. More specifically, the primary scan driving portion 57 executes a primary scan for the recording head 36 (and a PW sensor 80 which will be described below). Moreover, a head driving portion 58 drives the recording head 36 in the middle of the primary scan, thereby executing the recording to the paper P (and the optical disc D which will be described below). The carriage 33 mounts an ink cartridge 35 which is independent for each of a plurality of colors, and an ink is supplied from the ink cartridge 35 to the recording head 36.

A rib extended in a secondary scanning direction is formed on an opposed surface to the recording head 36 and a concave portion 37*a* into which the ink is to be thrown away is formed in the lower paper guide 37 for defining a distance between the paper P and the recording head 36. The ink discharged to a region getting out of the end of the paper P is thrown away into the concave portion 37*a* so that so-called marginless printing for carrying out printing over the end of the paper P without a margin is executed.

Successively, a guide roller 43 and the discharge roller 5 are provided on the downstream side of the recording head 36. The guide roller 43 fulfills the function of preventing a rise in the paper P from the lower paper guide 37 and maintaining the distance between the paper P and the recording head 36 to be constant. The discharge roller 5 is constituted to include a discharge driving roller 41 to be rotated and driven through a PF motor 164 (FIG. 3) and a discharge driven roller 42 to be driven and rotated in contact with the discharge driving roller 41. In the embodiment, a plurality of discharge driving rollers 41 which is formed by rubber rollers is provided in an axial direction of a shaft member to be rotated and driven.

Moreover, the discharge driven roller 42 is formed by a toothed roller having a plurality of teeth on an outer periphery. In addition, a paper discharge frame Assy 45 taking a long shape in the primary scanning direction is provided with a plurality of discharge driven rollers 42 corresponding to a plurality of discharge driving rollers 41. The paper P subjected to the recording by the recording means 3 is discharged toward the forward part of the apparatus (a stacker which is not shown) by the rotating and driving operation of the discharge driving roller 41 in a nipping state between the discharge driving roller 41 and the discharge driven roller 42.

The paper discharge frame Assy 45 is provided to be freely displaced by release means (not shown) in order to take a contact position in which the discharge driven roller 42 comes in contact with the discharge driving roller 41 and a separating position in which the discharge driven roller 42 separates from the discharge driving roller 41.

The components provided on the paper transport path have been described above. The printer 1 is constituted to freely carry out ink jet recording directly over the label surface of the optical disc (the thin plate-shaped member) such as a CD-R in addition to the cut-form paper acting as the medium. As shown in FIG. 1, the optical disc D acting as the medium is set to the tray 100 taking the shape of a plate and is transported through a linear tray transport path in the printer 1 in this condition. The tray 100 is constituted separately from the printer 1 and is supported by a tray guide 7 provided in the forward part of the printer 7, and at the same time, is manually inserted into the tray transport path toward the rear side (upstream side) of the printer 1 and is then fed in the secondary scanning direction by means of the transport roller 4. A structure of the tray 100 will be described below in detail.

With reference to FIG. 3, next, description will be given to a driving control portion 60 for executing a predetermined recording method by controlling each of the primary scan driving portion 57, the head driving portion 58, the secondary scan driving portion 59 and peripheral structures thereof. The driving control portion 60 is constituted to freely transmit and receive data together with a host computer 150 for transmitting print information (print data) to the printer 1, and includes an IF 61 to be an interface with the host computer 150, an ASIC 62, an RAM 63, a PROM 64 and an EEPROM 65, a CPU 66, a timer IC 67, a DC unit 68, a transporting motor (PF motor) driver 71, a carriage motor (CR motor) driver 70, and a head driver 69.

The CPU 66 carries out a calculation processing for executing a control program of the printer 1 and other necessary calculation processings, and the timer IC 67 generates a cyclic interruption signal which is required for various processings with respect to the CPU 66. The ASIC 62 serves to control a printing resolution and a driving waveform of the ink jet recording head 25 based on print data to be transmitted from the host computer 150 through the IF 61. The RAM 63 is used as a work area for the ASIC 62 and the CPU 66 and a primary storage area for other data, and the RROM 64 and the EEPROM 65 store various control programs (firmware) required for controlling the printer 1 and necessary data for a processing.

The DC unit 68 is a control circuit for controlling the speeds of the DC motors (a CR motor 73 and the PF motor 164), and has a PID control portion, an acceleration control portion and a PWM control circuit which are not shown. The DC unit 68 carries out various calculations for controlling the speeds of the DC motors based on a control instruction sent from the CPU 66 or a signal output from detecting means such as a rotary encoder 78, a linear encoder 79, the paper sensor 81 for detecting a passage of the recording paper P or the PW sensor 80, and sends a signal to the CR motor driver 70 and the PF motor driver 71.

The PF motor driver 71 drives and controls the PF motor 164 to be the "motor for a transport driving roller" under the control of the DC unit 68. The PF motor 164 rotates a plurality of driving targets, that is, the feed roller 13, the transport driving roller 30 and the discharge driving roller 41 in the embodiment.

The CR motor driver 70 drives and controls the CR motor 73 to be the "motor for a carriage" under the control of the DC unit 68, thereby reciprocating the carriage 33 in the primary scanning direction or stopping and holding the carriage 33. The head driver 69 drives and controls the recording head 25 in accordance with print data transmitted from the host computer 150 under the control of the CPU 66.

A detection signal sent from the paper sensor 81 for detecting a start end and a termination of the paper P to be transported, a signal output from the rotary encoder 78 for detecting the amount, direction and speed of the rotation of the PF motor 164, and a signal output from the linear encoder 79 for detecting an absolute position in the primary scanning direction of the carriage 33 are given to the CPU 66 and the DC unit 68. Moreover, a signal output from the PW sensor 80 is also given to the CPU 66 and the DC unit 68.

The PW sensor 80 is an optical sensor provided in the bottom part of the carriage 33 and is constituted to include a light emitting portion (not shown) for emitting a light toward the paper P or the tray 100, and a light receiving portion (not shown) for receiving a light reflected from the paper P or the tray 100, and detects a difference in a reflectance on the recording paper P or a difference in a reflectance on the tray 100. Consequently, the control portion 60 detects the presence of the paper P and the width of the paper P with the sensing of the PW sensor 80.

When the PW sensor 80 senses a detected portion (which will be described below) provided on the tray 100 as will be described below, moreover, the control portion 60 calculates a central position of a set portion 102 (which will be described below) in the tray 100. Based on information about the central position thus detected, a position of a recording region with the primary scanning direction and the secondary scanning direction set to be coordinate systems is determined.

The rotary encoder 78 includes a disk-shaped scale (not shown) having a large number of light transmitting portions in an outer peripheral part and a detecting portion (not shown) having a light emitting portion for emitting a light to the light transmitting portion and a light receiving portion for receiving a light passing through the light transmitting portion, and the detecting portion outputs a rise signal and a fall signal which are generated by the light passing through the light transmitting portion in accordance with a rotation of the disk-shaped scale and the driving control portion 60 receives the signal output from the rotary encoder 78, thereby detecting the amount, speed and direction of the rotation of the transport driving roller 30. Consequently, it is possible to execute a feed control (a secondary scanning feed) of the paper P or the tray 100 which is intended.

The linear encoder 79 includes a sign plate **79*b* which is long in the primary scanning direction and a detecting portion 79*a* having a light emitting portion for emitting a light to a plurality of light transmitting portions formed in the primary scanning direction and a light receiving portion for receiving a light passing through the light transmitting portion in the sign plate 79*b*. The detecting portion 79*a* outputs a rise signal and a fall signal which are generated by the light passing through the light transmitting portion, and the driving control portion 60 receives the signal output from the detecting portion 79*a*, thereby detecting a position in the primary scanning direction of the carriage 33 (that is, the PW sensor 80**).

The PF motor driver 71 and the PF motor 164 constitute the secondary scan driving portion 59 shown in FIG. 1, the CR motor driver 70 and the CR motor 73 constitute the primary scan driving portion 57, and the head driver 69 constitutes the head driving portion 58.

Figure 4:
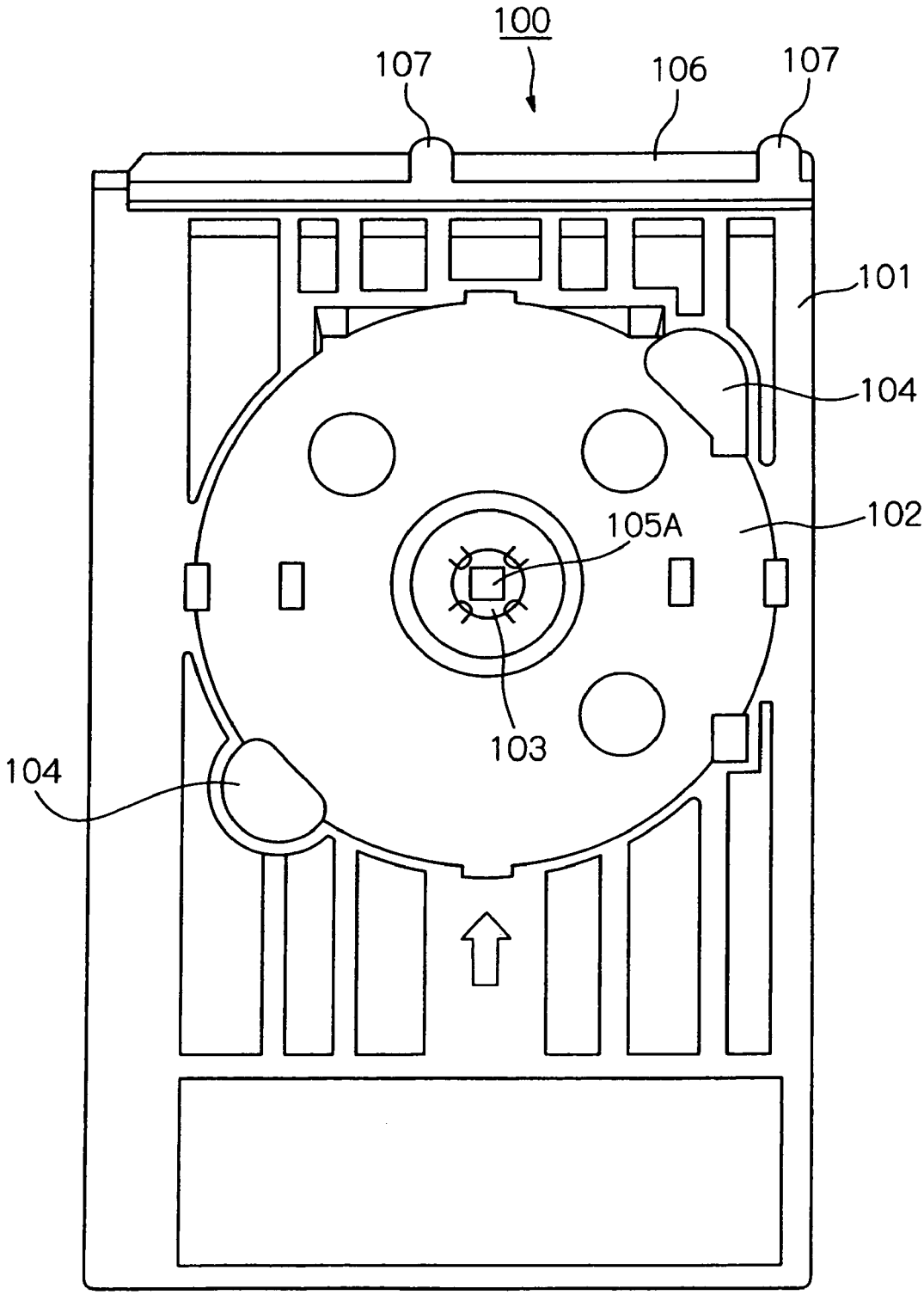
FIG. 4 is a plan view showing a tray recording to the embodiment of the invention.
Figure 5:
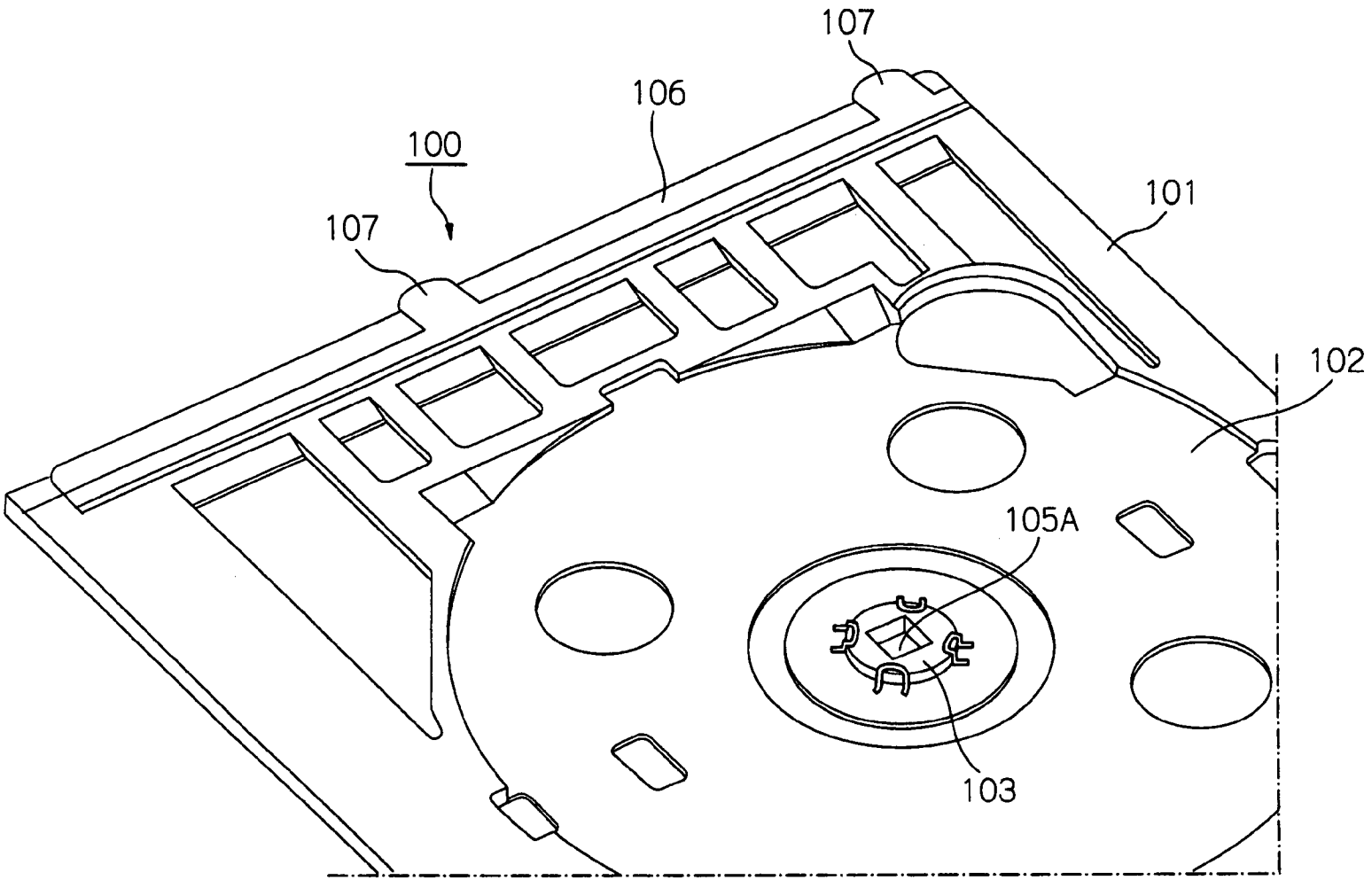
FIG. 5 is a perspective view showing a tip of the tray recording to the embodiment of the invention.

The summary of the printer 1 has been described above, and the structure of the tray 100 will be described below in detail with reference to FIGS. 4 and 5. FIG. 4 is a plan view showing the tray 100 and FIG. 5 is a perspective view showing an appearance of a tip of the tray 100.

As shown in FIG. 4, the tray 100 has a rectangular shape seen on a plane and takes a shape of a plate which can be nipped between the transport driving roller 30 and the transport driven roller 31, and furthermore, can carry out the secondary scanning feed with the rotation of the transport driving roller 30.

The tray 100 is formed integrally by a resin material in order to include a tray body 101 and the set portion 102. The set portion 102 is constituted by a concave portion taking a circular shape seen on a plane as shown. A convex portion 103 to be a "fitting portion" is formed on the center of the set portion 102. When the optical disc D is set to the set portion 102, a fitting hole (a central hole) Dh (FIG. 1) of the optical disc D is fitted around the convex portion 103. Consequently, a position of the optical disc D in the set portion 102 (the tray 100) is determined. Holes 104 and 104 formed around the set portion 102 are used for taking out (ejecting) the optical disc D.

A vertical direction in FIG. 4 is set to be a direction of transport of the tray 100 (the secondary scanning direction). When the tray 100 is to be inserted (fed) into the transport path of the tray 100 through the tray guide 7 as described above, the tray 100 is inserted with an upper part of FIG. 4 set to be a tip. More specifically, the reference numeral 106 denotes a tip of the tray 100. Tongue piece portions 107 and 107 are formed integrally with the tray 100 in the tip of the tray 100 so as to be protruded in the direction of insertion of the tray 100 as shown in FIG. 5.

The tongue piece portion 107 is tapered toward the tip and has a bottom face to form a flat surface together with the bottom face of the tray body 101 as shown in FIG. 5. Moreover, the tip 106 of the tray 100 is also formed to be tapered toward the tip in the same manner as the tongue piece portion 107.

The tongue piece portion 107 has the following functions and advantages. More specifically, when the tray 100 is to be inserted into the transport path for the tray 100, the tip 106 of the tray 100 is set to be a head and the tray 100 is thus inserted toward the rear side of the printer 1 through the tray guide 7.

In order to feed the tray 100 in the secondary scanning direction by means of the transport driving roller 30 and the transport driven roller 31, it is necessary to insert the tip 106 of the tray 100 into a portion between the transport driving roller 30 and the transport driven roller 31. However, the tongue piece portion 107 is formed on the tip 106 of the tray 100. When the tray 100 is fed toward the transport roller 4 by feeding means which is not shown, therefore, the tongue piece portion 107 enters the portion between the transport driving roller 30 and the transport driven roller 31. Consequently, the tip 106 of the tray 100 then enters the portion between the transport driving roller 30 and the transport driven roller 31 so that the tray 100 is nipped between both of the rollers soon.

More specifically, an area of the tip of the tray 100 (seen on a plane) is reduced very greatly by the tongue piece portion 107. Therefore, the tip 106 of the tray 100 can easily be caused to enter the portion between the transport driving roller 30 and the transport driven roller 31 by a small force. Accordingly, it is possible to cause the tray 100 to enter the portion between the transport driving roller 30 and the transport driven roller 31 without using means for separating (releasing) the transport driven roller 31 from the transport driving roller 30.

Figure 6:
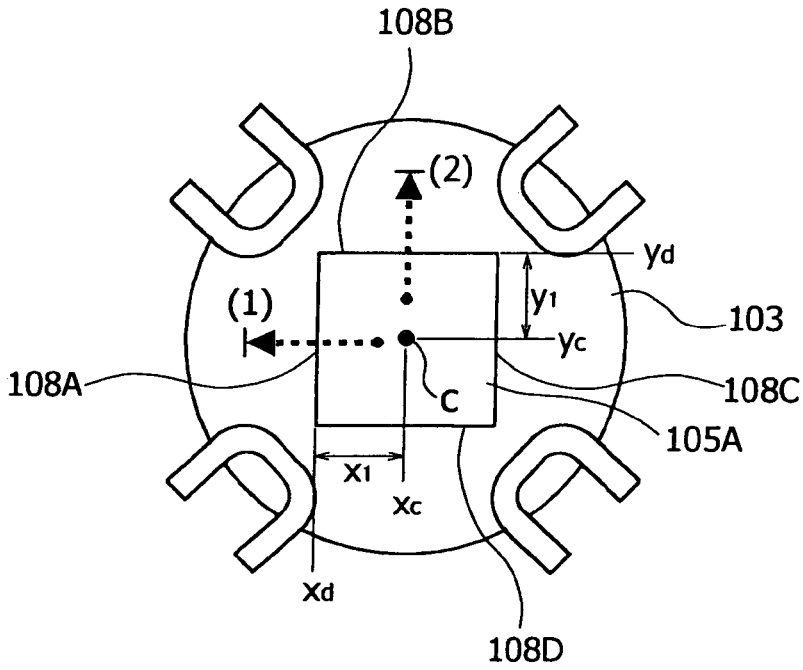
FIG. 6 is a plan view showing a detected portion (a first embodiment)

As shown in FIGS. 4 and 5, subsequently, a detected portion 105A to be detected by the PW sensor 80 is formed in the convex portion 103. The detected portion 105A (in the same manner as detected portions 105B, 105C and 105D which will be described below) is formed by a hole penetrating through the tray body 101. Consequently, a difference is made on a reflectivity at the inside and outside (the convex portion 103) of the detected portion 105A. More specifically, the detected portion 105A takes a shape of a square or a rectangle (one plane figure) constituted by a first detected line 108A and a third detected line 108C which are orthogonal to the primary scanning direction (a transverse direction in FIGS. 4, 6 to 13, and 17 to 20) and a second detected line 108B and a fourth detected line 108D which are orthogonal to the secondary scanning direction (a vertical direction in FIGS. 4, 6 to 13, and 17 to 20) which are formed by boundary lines between regions (the inside and outside of the hole) having different reflectivities as shown in FIG. 6. The "detected line" implies a boundary line between regions having different reflectivities which can be detected by the PW sensor 80.

Moreover, the position in the primary scanning direction of the tray 100 is regulated by means of the tray guide 7. Therefore, the control portion 60 (FIG. 3) can previously hold information about a position in the primary scanning direction of the detected portion 105A (the convex portion 103), and furthermore, can obtain information about a position in the secondary scanning direction of the detected portion 105A (the convex portion 103) by detecting a change in the reflectance in the passage of the tip 106 of the tray 100 through the PW sensor 80, for example. The tray 100 may be separately provided with a special detected portion (a reflecting mark) for knowing the position in the secondary scanning direction of the detected portion 105A. Moreover, the control portion 60 can previously hold the information about the position in the primary scanning direction of the detected portion 105A (the convex portion 103). By placing the PW sensor 80 in that position and then feeding the tray 100 in the secondary scanning direction, therefore, it is possible to directly detect the detected portion 105A, thereby obtaining the information about the position in the secondary scanning direction of the detected portion 105A.

Figure 10:
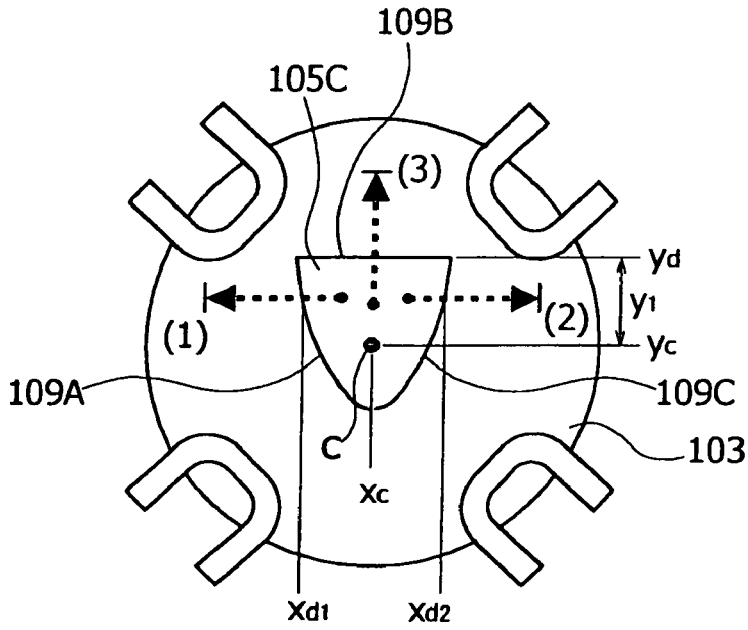
FIG. 10 is a plan view showing the detected portion (a variant of the third embodiment)
Figure 11:
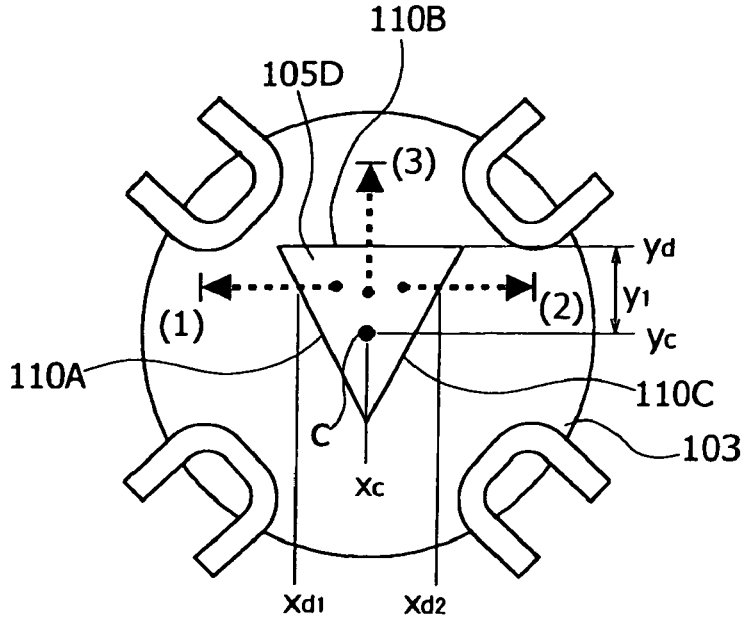
FIG. 11 is a plan view showing the detected portion (a variant of the third embodiment)
Figure 14:
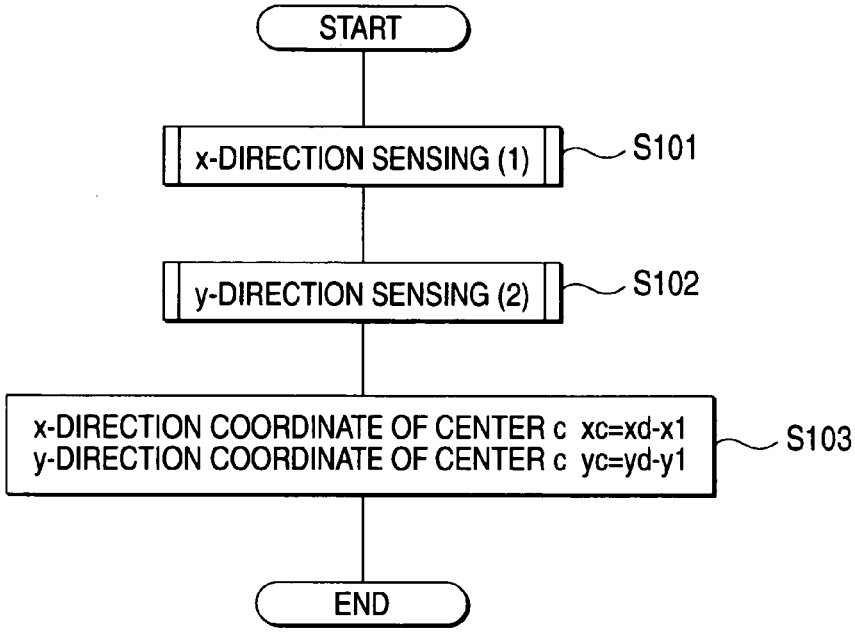
FIG. 14 is a flowchart showing the contents of a sequence for obtaining the central coordinates of a set portion.
Figure 15:
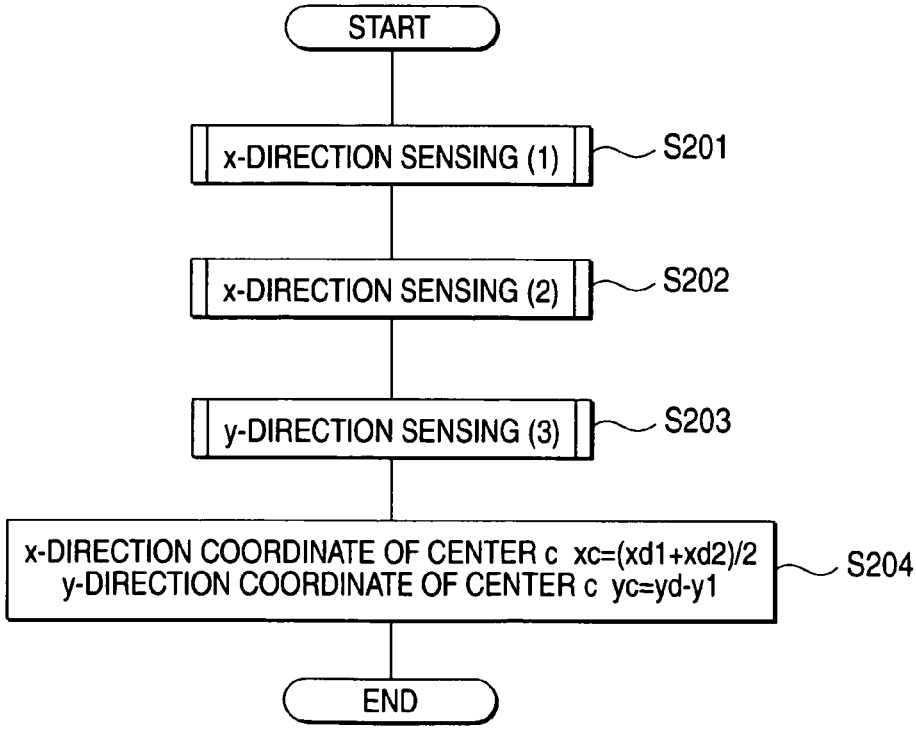
FIG. 15 is a flowchart showing the contents of the sequence for obtaining the central coordinates of the set portion.
Figure 16:
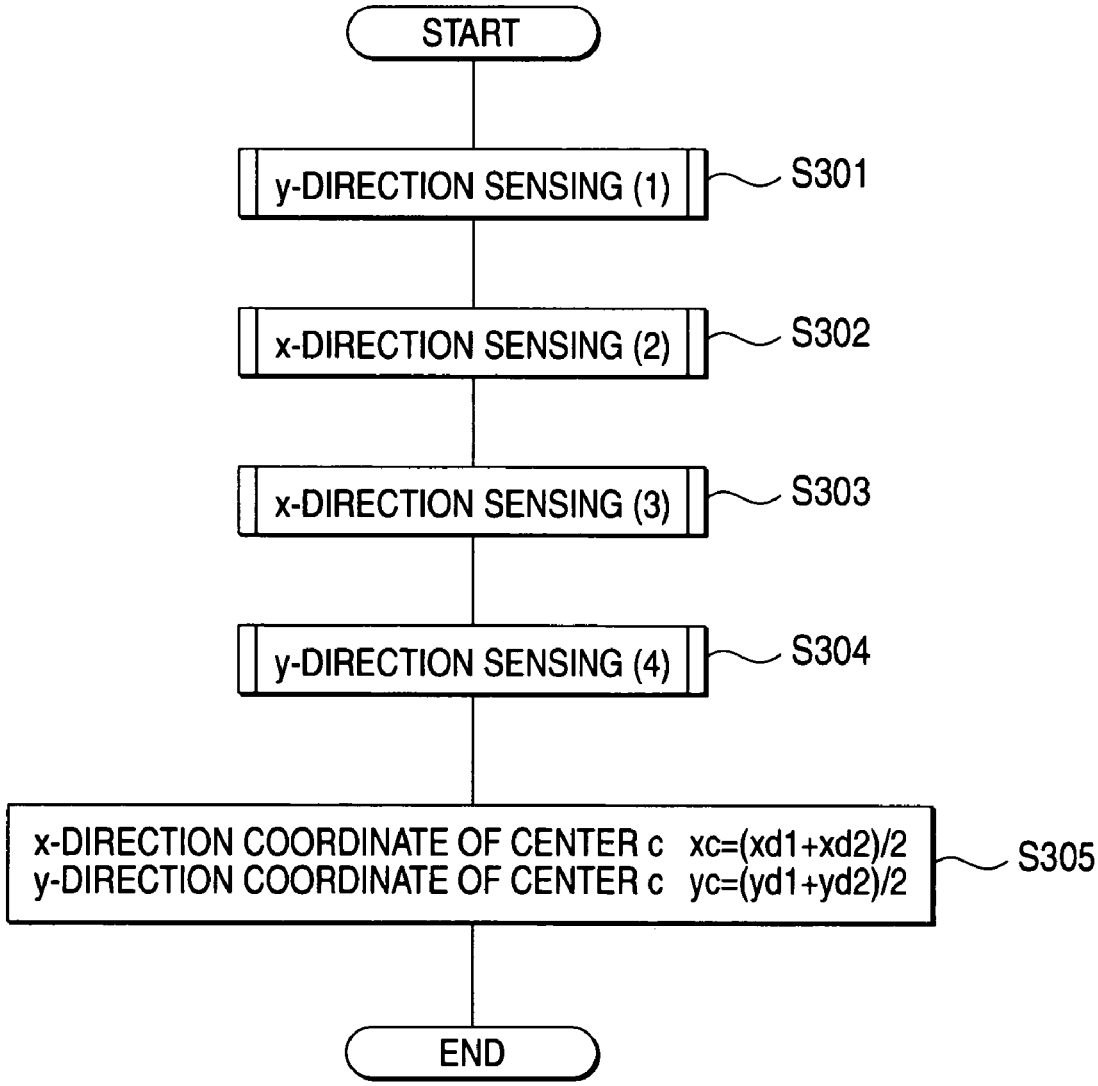
FIG. 16 is a flowchart showing the contents of the sequence for obtaining the central coordinates of the set portion.
Figure 17:
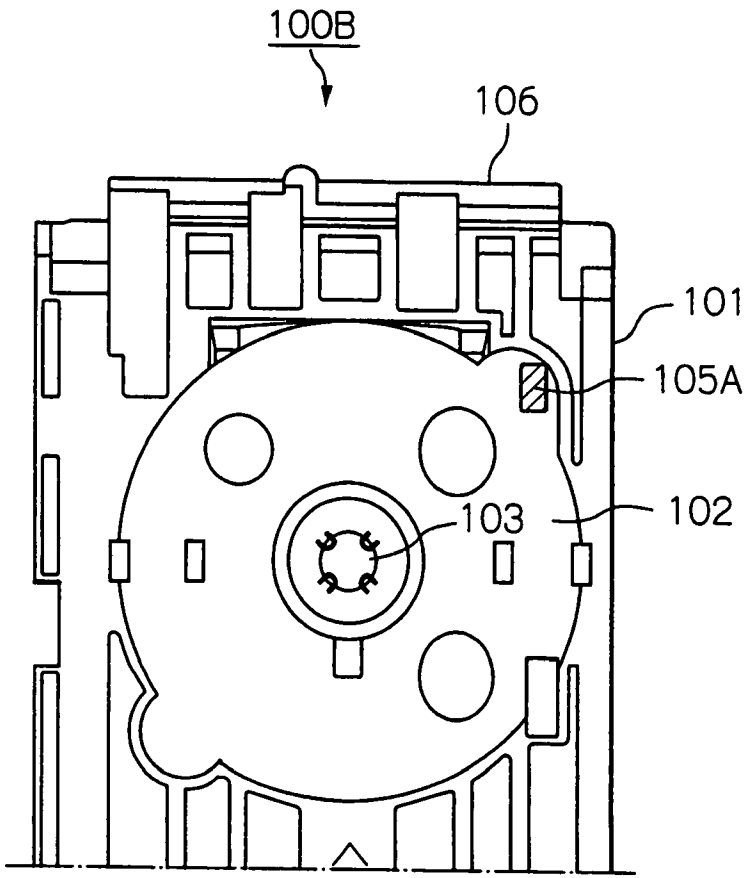
FIG. 17 is a plan view showing a tray recording to the embodiment of the invention.
Figure 17:
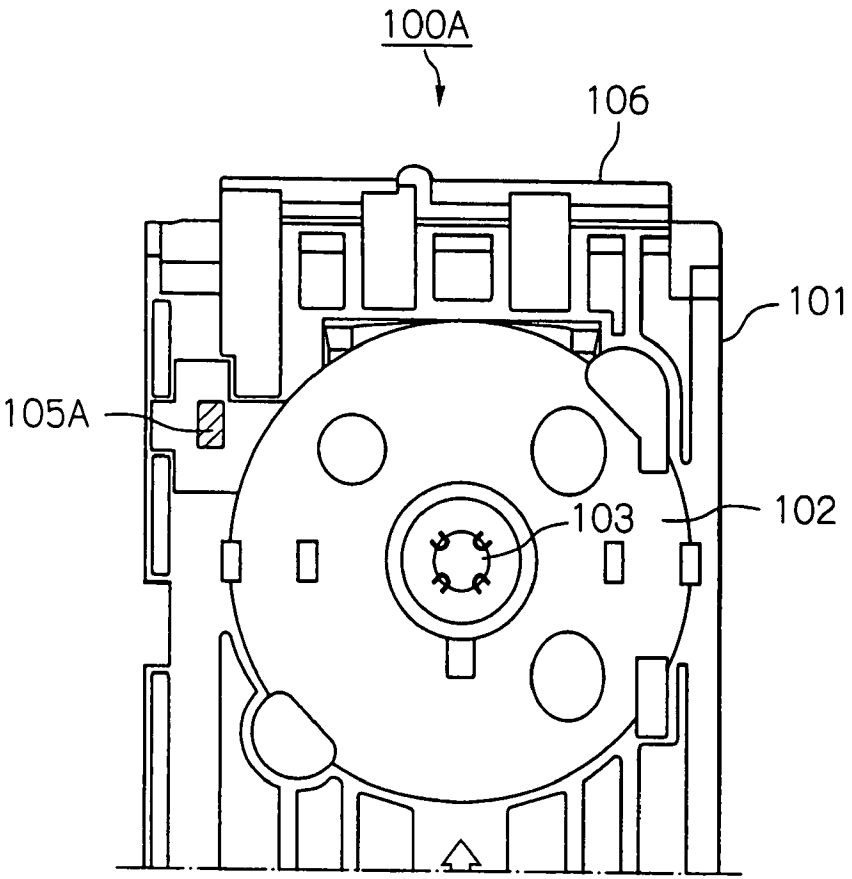
Figure 18:
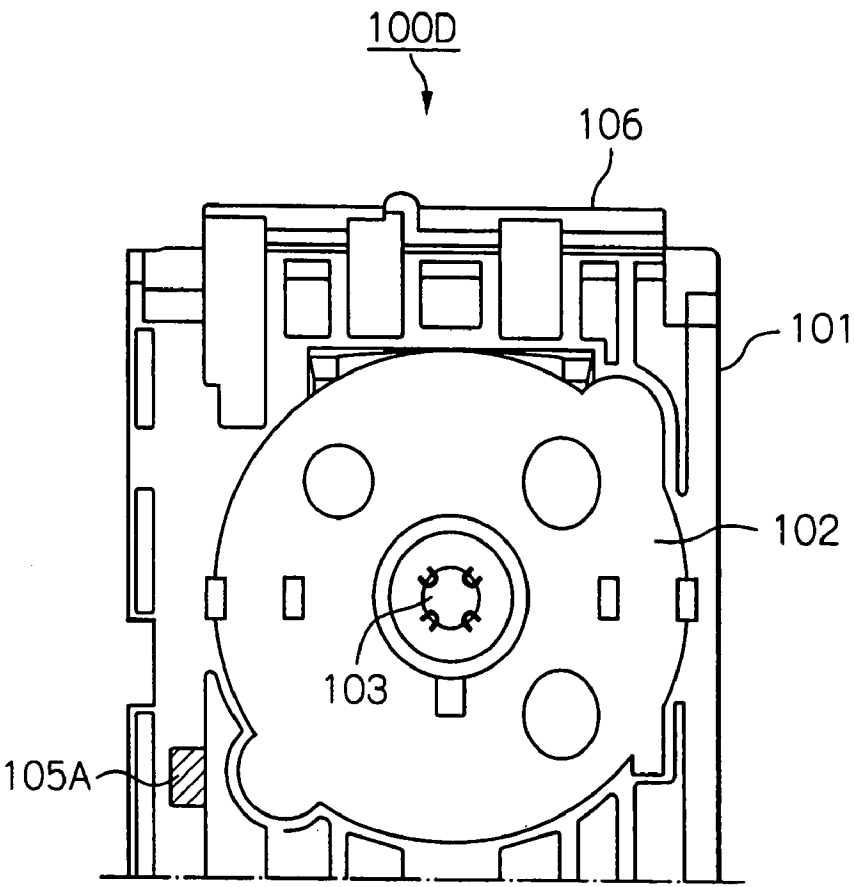
FIG. 18 is a plan view showing the tray recording to the embodiment of the invention.
Figure 18:
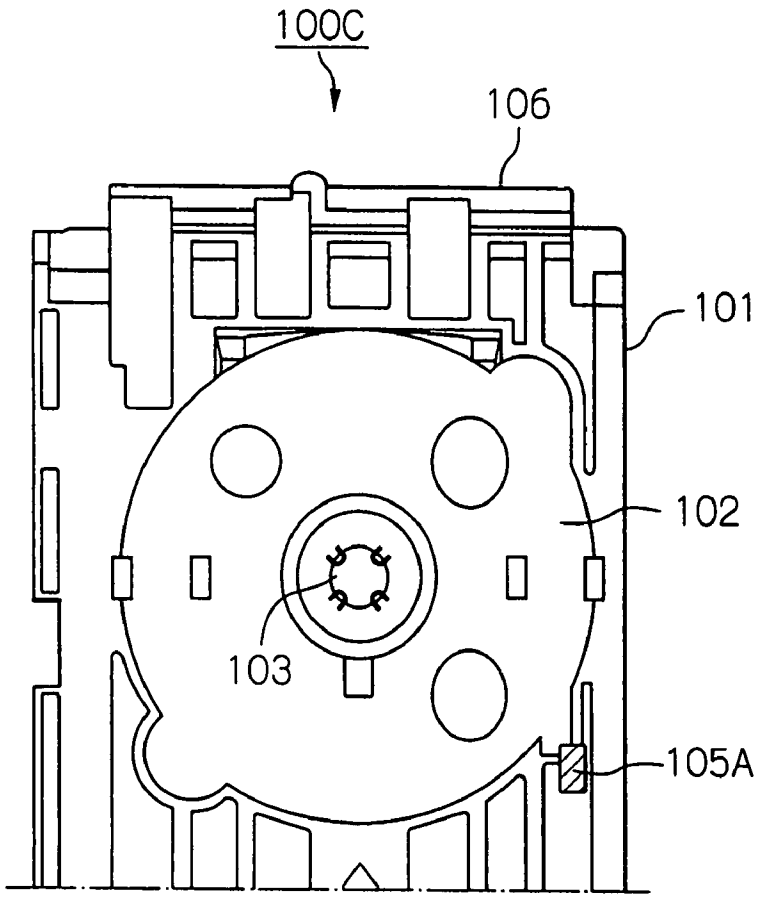
Figure 19:
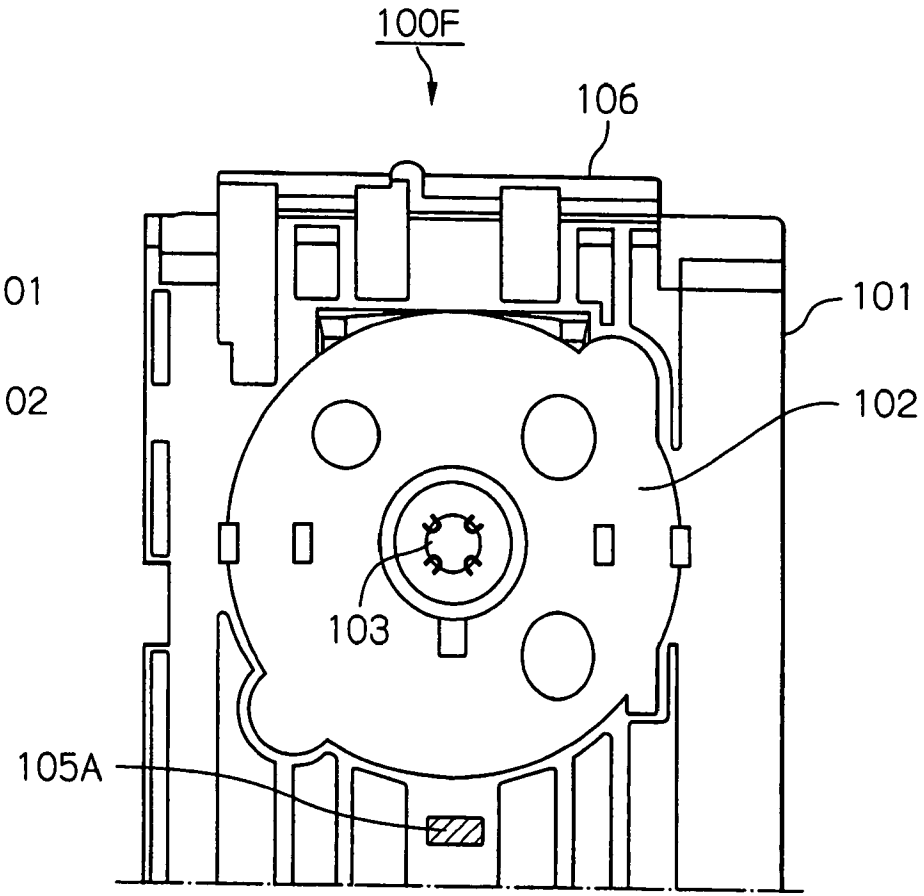
FIG. 19 is a plan view showing the tray recording to the embodiment of the invention.
Figure 19:
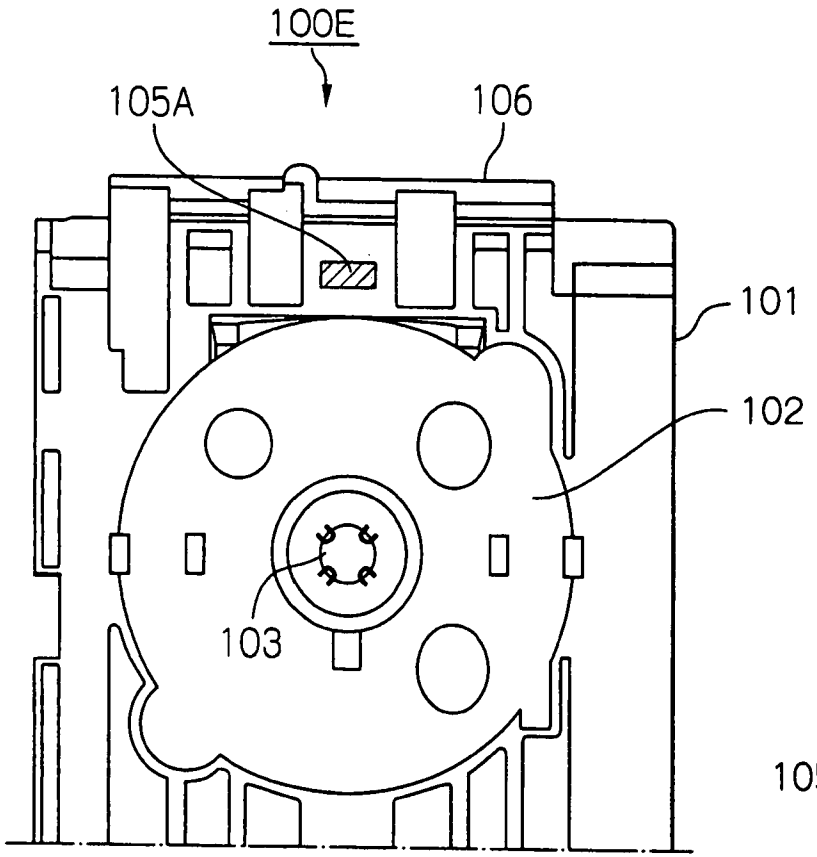
Figure 20:
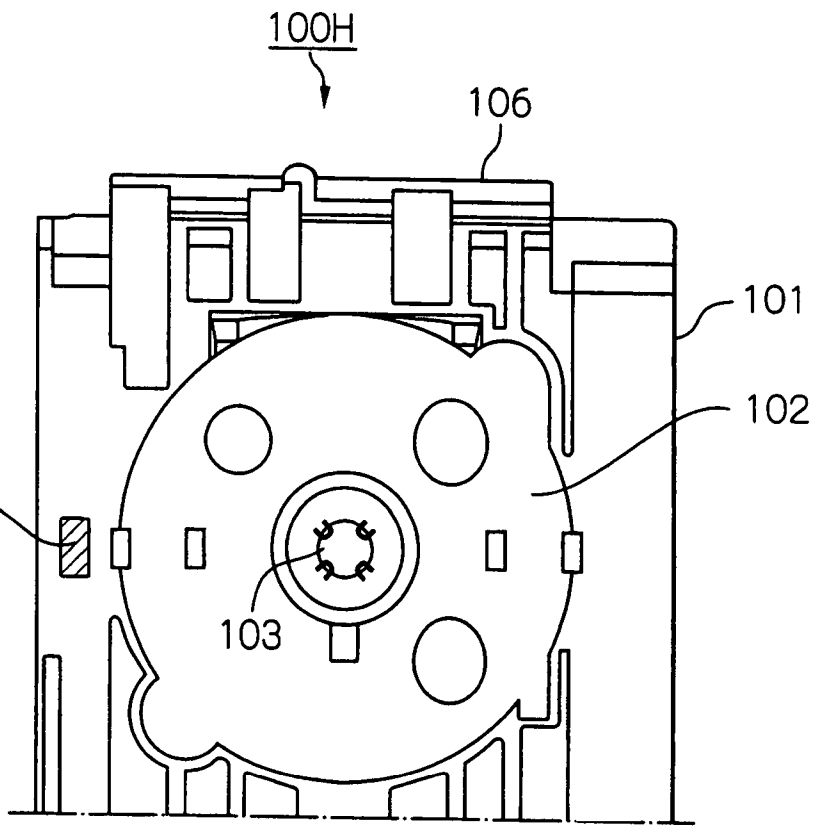
FIG. 20 is a plan view showing the tray recording to the embodiment of the invention.
Figure 20:
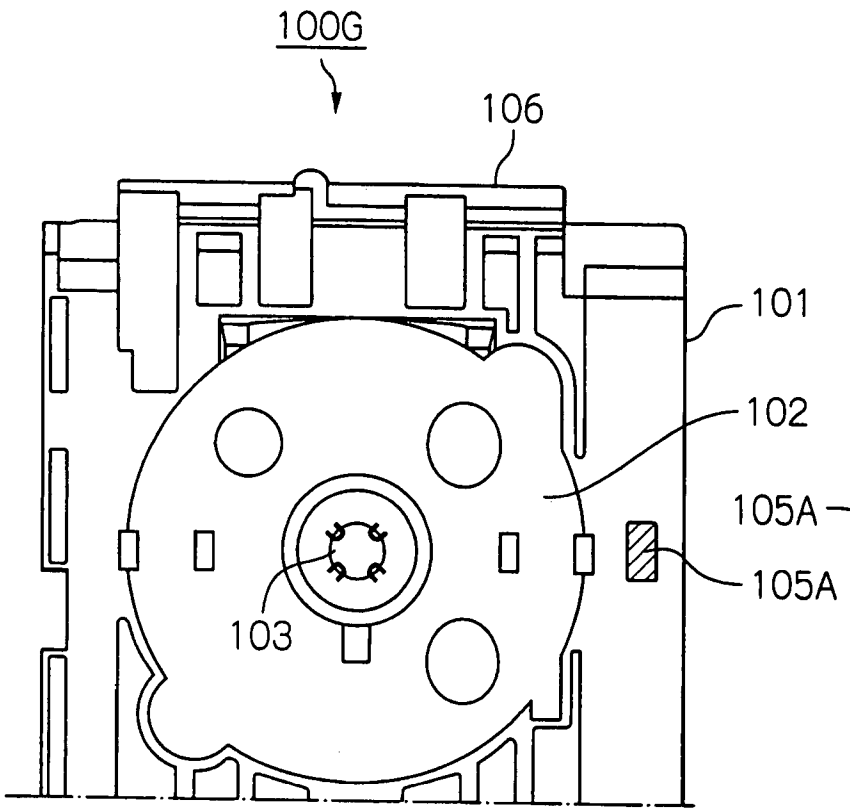

The role of the detected portion 105A will be described below in detail with reference to FIGS. 6 to 16. FIGS. 6, 7, 9, 12 and 13 are plan views showing the detected portion 105A, and FIGS. 8, 10 and 11 are plan views showing the detected portions 105B, 105C and 105D according to a variant of the detected portion 105A respectively. Moreover, FIGS. 14 to 16 are flowcharts showing the contents of a sequence for obtaining position coordinates of a center c of the set portion 102.

When the recording is to be executed over the label surface of the optical disc D set to the tray 100, a region over which the recording is to be executed is set based on the position coordinates of the center (indicated as "c" in FIGS. 6 to 13) of the set portion 102 (the convex portion 103). The position coordinates are obtained by driving the carriage 33 (the CR motor 73) to trace the detected portion 105A (or the detected portions 105B to 105D which will be described below) in the primary scanning direction through the PW sensor 80 and driving the transport driving roller 30 (the PF motor 164) to trace the detected portion 105A (or the detected portions 105B to 105D which will be described below) in the secondary scanning direction through the PW sensor 80. In the following, coordinates in the primary scanning direction and the secondary scanning direction of the center c (which will be properly referred to as an "x direction" and a "y direction") are represented by $x_c$ and $y_c$, respectively.

In FIGS. 6 to 13, arrows indicated as (1) to (4) represent a trace line and a direction thereof in the sensing carried out by the PW sensor 80.

In a first embodiment shown in FIG. 6, the carriage 33 and the transport driving roller 31 are driven and controlled in such a manner that a trace line obtained in the sensing of the first detected line 108A through the PW sensor 80 does not cross the convex portion 103 in the x direction as shown in the arrow (1) and a trace line in the sensing of the second detected line 108B through the PW sensor 80 does not cross the convex portion 103 in the y direction as shown in the arrow (2).

Figure 7:
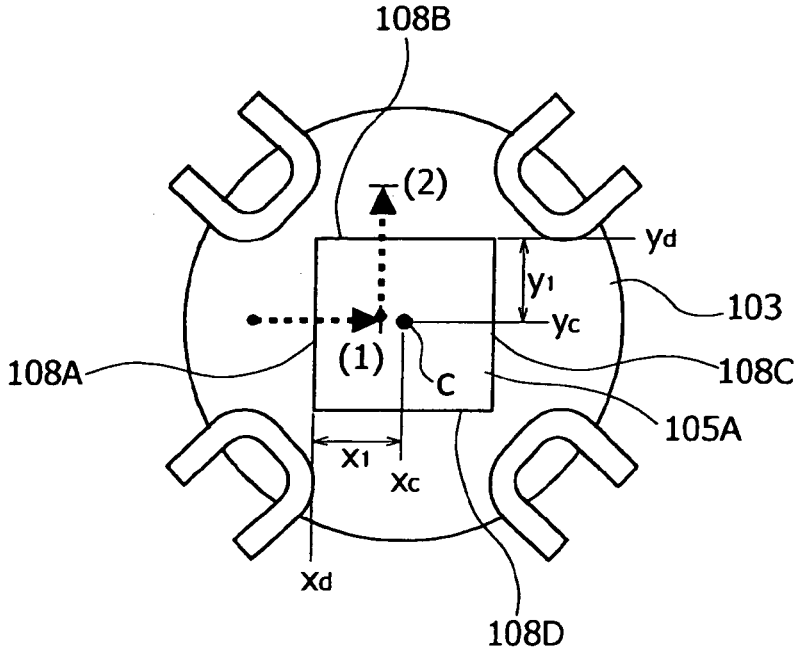
FIG. 7 is a plan view showing the detected portion (a second embodiment)
Figure 8:
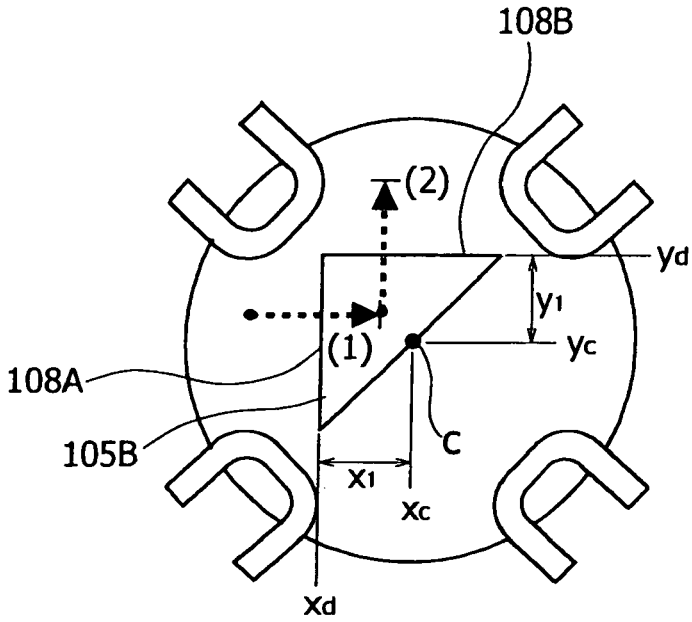
FIG. 8 is a plan view showing the detected portion (a variant of the second embodiment)

In a second embodiment shown in FIG. 7, the carriage 33 and the transport driving roller 31 are driven and controlled in such a manner that the trace line of the PW sensor 80 does not cross the convex portion 103 in the same manner as in the first embodiment but particularly crosses the first detected line 108A and then crosses the second detected line 108B without getting out of the convex portion 103 (and furthermore, the detected portion 105A) in the embodiment as shown in the arrows (1) and (2).

FIG. 14 shows a procedure for obtaining the coordinates $x_c$ and $y_c$ through the sensing of the PW sensor 80. A coordinate $x_d$ in the primary scanning direction of the first detected line 108A is detected by a sensing (1) in the x direction (Step S101) and a coordinate $y_d$ in the secondary scanning direction of the second detected line 108B is detected by a sensing (2) in the y direction (Step S102).

As shown in FIGS. 6 and 7, the coordinate $x_d$ and the center c are separated from each other by a distance $x_1$ in the x direction and the coordinate $y_d$ and the center c are separated from each other by a distance $y_1$ in the y direction, and the values $x_1$ and $y_1$ are previously written to the ROM 64 or the EEPROM 65 (FIG. 3). By detecting the coordinates $x_d$ and $y_d$, accordingly, it is possible to obtain the coordinate $x_c$ in the x direction of the center c with $x_d-x_1$ and to obtain the coordinate $y_c$ in the y direction of the center c with $y_d-y_1$ as shown in Step S103 of FIG. 14.

As described above, in the first and second embodiments shown in FIGS. 6 and 7, the carriage 33 and the transport driving roller 31 are driven and controlled in such a manner that the trace line of the PW sensor 80 does not cross the convex portion 103. In the second embodiment shown in FIG. 7, moreover, the carriage 33 and the transport driving roller 31 are driven and controlled in such a manner that the trace line crosses the first detected line 108A and then crosses the second detected line 108B without getting out of the convex portion 103 (and furthermore, the detected portion 105A).

In any case, therefore, it is sufficient that the amount of the movement of the carriage 33 and the amount of the secondary scanning feed of the tray 100 are small, a deterioration in precision in the detection of the coordinate $x_c$ in the x direction and the coordinate $y_c$ in the y direction of the center c can be prevented still more reliably, and furthermore, it is possible to shorten a time required for the sensing of the PW sensor 80 when obtaining the position of the center c. In particular, it is sufficient that the trace line of the PW sensor 80 is very short in the second embodiment. Therefore, it is possible to shorten the time required for the sensing still more greatly.

In the first and second embodiments, the two lines, that is, the first detected line 108A and the second detected line 108B are detected. Therefore, it is also possible to form the detected portion 105A by a right triangle as indicated by 105B in FIG. 8. Consequently, it is sufficient that the area of the detected portion (hole) is small, and a strength of the convex portion 103 can be thus enhanced.

In the first and second embodiments, moreover, it is also possible to carry out the same sensing by using two other detected lines, that is, the third detected line 108C and the fourth detected line 108D. Thus, the third detected line 108C and the fourth detected line 108D are further provided in addition to the first detected line 108A and the second detected line 108B. Therefore, it is possible to enhance the degree of freedom of a control.

Figure 9:
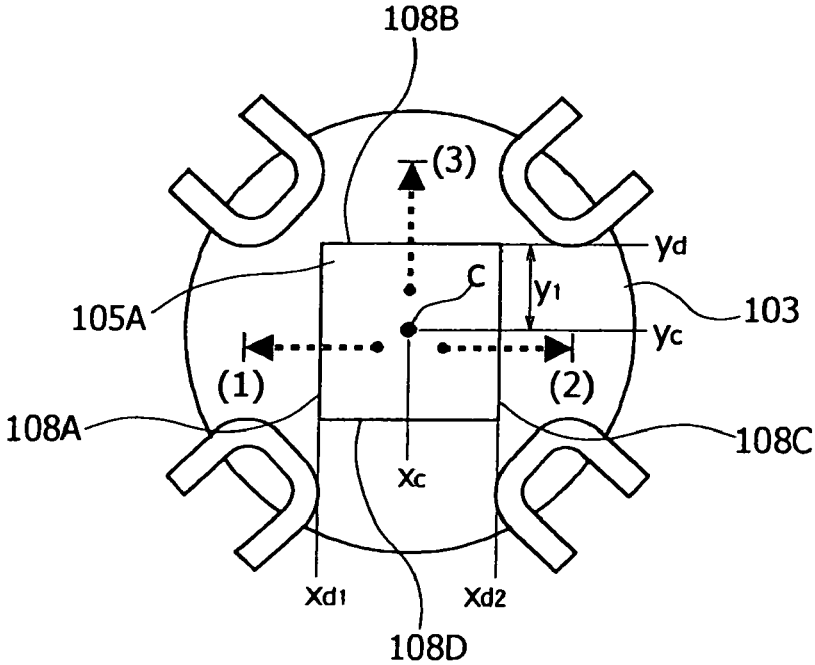
FIG. 9 is a plan view showing the detected portion (a third embodiment)

In a third embodiment shown in FIG. 9, next, a coordinate $x_{d1}$ in an x direction of a first detected line 108A and a coordinate $x_{d2}$ in the x direction of a third detected line 108C are used to obtain a coordinate $x_c$ in the x direction of a center c. In more detail, as shown in FIG. 15, the coordinate $x_{d1}$ in the x direction of the first detected line 108A is detected by a first sensing (1) in the x direction (Step S201) and the coordinate $x_{d2}$ in the x direction of the third detected line 108C is detected by a second sensing (2) in the x direction (Step S202). Then, a coordinate $y_d$ in a y direction of a second detected line 108B is detected by a sensing (3) in the y direction (Step S203).

By detecting the coordinates $x_{d1}$, $x_{d2}$ and $y_d$, accordingly, the coordinate $x_c$ in the x direction of the center c can be obtained with $(x_{d1}+x_{d2})/2$ and a coordinate $y_c$ in the y direction of the center c can be obtained with $y_d-y_1$ as shown in Step S204 of FIG. 15.

As described above, the coordinate $x_c$ in the x direction of the center c is obtained by setting two positions, that is, a position of the first detected line 108A and that of the third detected line 108C as references. Also in the case in which precision in detection of the first detected line 108A or the third detected line 108C is deteriorated, therefore, it is possible to reduce an error (by half).

In the embodiment, thus, the center c is assumed to be positioned between the first detected line 108A and the third detected line 108C. For this reason, the center c is managed to be positioned between the first detected line 108A and the third detected line 108C in respect of the manufacture of the tray 100.

Moreover, the detected portion 105A can also be caused to take a semielliptical shape indicated as the reference numeral 105C in FIG. 10 or a shape of an isosceles triangle indicated as the reference numeral 105D in FIG. 11. Accordingly, the detected line does not need to be orthogonal to the primary scanning direction or the secondary scanning direction. Moreover, the detected line does not need to be a straight line.

Figure 12:
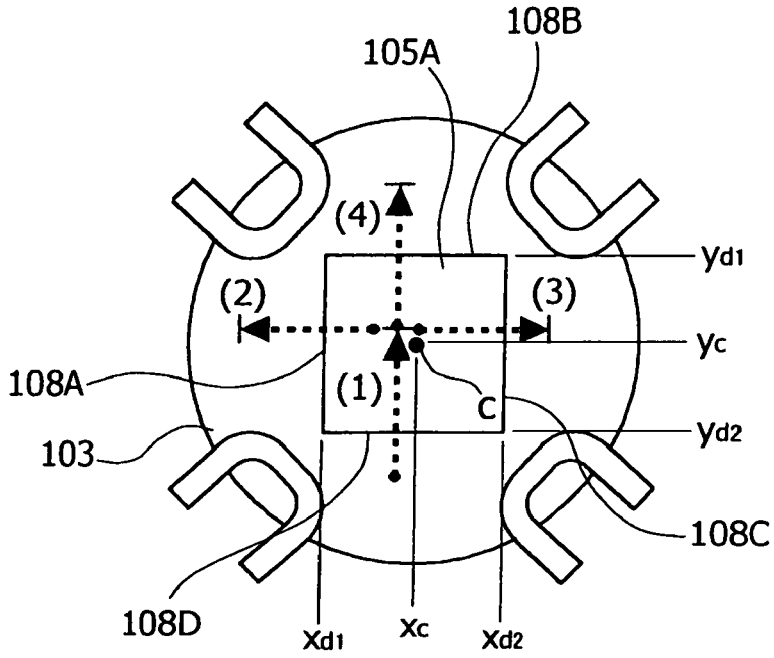
FIG. 12 is a plan view showing the detected portion (a fourth embodiment)
Figure 13:
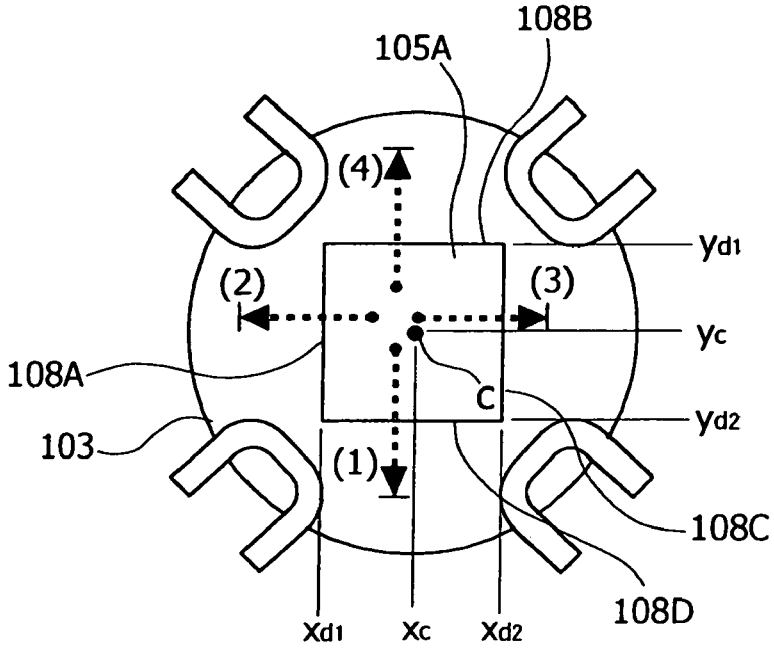
FIG. 13 is a plan view showing the detected portion (a variant of the fourth embodiment)

In a fourth embodiment shown in FIG. 12, next, a coordinate $x_{d1}$ in an x direction of a first detected line 108A and a coordinate $x_{d2}$ in the x direction of a third detected line 108C are used to obtain a coordinate $x_c$ in the x direction of a center c, and a coordinate $y_{d1}$ in a y direction of a second detected line 108B and a coordinate $y_{d2}$ in the y direction of a fourth detected line 108D are used to obtain a coordinate $y_c$ in the y direction of the center c. In more detail, as shown in FIG. 16, the coordinate $y_{d2}$ in the y direction of the fourth detected line 108D is detected by a sensing (1) in the y direction of the PW sensor 80 (Step S301) and the coordinates $x_{d1}$ in the x direction of the first detected line 108A and the coordinates $x_{d2}$ in the x direction of the third detected line 108C are subsequently detected by sensings (2) and (3) in the x direction of the PW sensor 80 (Steps S302 and S303). Then, the coordinate $y_{d1}$ in the y direction of the second detected line 108B is detected by a sensing (4) in the y direction (Step S304).

By detecting the coordinates $x_{d1}$, $x_{d2}$, $y_{d1}$ and $y_{d2}$, accordingly, the coordinate $x_c$ in the x direction of the center c can be obtained with $(x_{d1}+x_{d2})/2$ and a coordinate $y_c$ in the y direction of the center c can be obtained with $(y_{d1}+y_{d2})/2$ as shown in Step S305 of FIG. 16.

As described above, the coordinate $x_c$ in the x direction of the center c is obtained by setting two positions, that is, a position of the first detected line 108A and that of the third detected line 108C as references, and the coordinate $y_c$ in the y direction of the center c is obtained by setting two positions, that is, a position of the fourth detected line 108D and that of the second detected line 108B as references. Also in the case in which precision in detection of the respective detected lines is deteriorated, therefore, it is possible to reduce an error (by half).

Moreover, the secondary scanning feed of the tray 100 is set into one direction. Therefore, it is sufficient that the amount of the secondary scanning feed is small, and furthermore, the normal rotation/reverse rotation of the transport driving roller 30 does not need to be switched. Consequently, it is possible to detect the position of the second detected line 108B or the fourth detected line 108D more accurately without using a backlash of a gear in a power transmission system. However, this is not restricted but it is a matter of course that the position of the second detected line 108B or the fourth detected line 108D can also be detected by the secondary scanning feed in two directions shown in FIG. 13.

In the embodiment, thus, the center c is positioned between the first detected line 108A and the third detected line 108C, and the center c is positioned between the second detected line 108B and the fourth detected line 108D. Therefore, the center c is managed to be positioned between the first detected line 108A and the third detected line 108C and between the second detected line 108B and the fourth detected line 108D in respect of the manufacture of the tray 100.

Also in both of the third and fourth embodiments described above, the carriage 33 and the transport driving roller 31 are driven and controlled in such a manner that the trace line of the PW sensor 80 does not cross the convex portion 103 in the same manner as in the first and second embodiments described above. Therefore, it is sufficient that the amount of the movement of the carriage 33 and the amount of the secondary scanning feed of the tray 100 are small, a deterioration in precision in the detection of the coordinate $x_c$ in the x direction and the coordinate $y_c$ in the y direction of the center c can be prevented still more reliably, and furthermore, it is possible to considerably shorten a time required for the sensing when obtaining the coordinate $x_c$ in the x direction and the coordinate $y_c$ in the y direction of the center c.

Although the detected portions 105A to 105D are formed in the convex portion 103 in the embodiment, it is also possible to provide them in any place of the tray body 101. By providing the detected portions 105A to 105D in the convex portion 103, the distance between the center c and the detected portions 105A to 105D is reduced. Consequently, it is possible to prevent a positional shift of the center c from being caused by a dimensional error of the tray 100.

Another Embodiment of Tray

With reference to FIGS. 17 to 20, description will be given to another embodiment of the tray 100. FIGS. 17 to 20 are plan views showing a tray according to another embodiment. In FIGS. 17 to 20, the same components as those in the tray 100 have the same reference numerals and description thereof will be omitted.

In trays 100A to 100H shown in FIGS. 17 to 20, a detected portion 105A is not disposed on an inside of a set portion 102 (a fitting portion 103) but an outside of the set portion 102.

In the trays 100A, 100B, 100C and 100D shown in FIGS. 17(A) and (B) and FIGS. 18(A) and (B), particularly, the position of the detected portion 105A is placed away from the central position in the primary scanning direction and that in the secondary scanning direction of the set portion 102 within a range of the formation of the set portion 102 in the primary scanning direction (to which the trays 100B and 100C correspond), the range of the formation of the set portion 102 in the secondary scanning direction (to which the trays 100A, 100B, 100C and 100D correspond) or the range of the formation of the set portion 102 in both the primary scanning direction and the secondary scanning direction (to which the trays 100B and 100C correspond).

More specifically, the tray 100 takes a square shape seen on a plane, and the set portion 102 takes a circular shape seen on the plane. In particular, therefore, the adjacent position to the set portion 102, that is, the range of the formation of the set portion 102 in the primary scanning direction and the secondary scanning direction becomes a residual space. By utilizing such a residual space to dispose the detected portion 105A, therefore, it is possible to prevent an increase in the size of the tray in the case in which the detected portion 105A is disposed on the outside of the set portion 102.

On the other hand, in the trays 100E, 100F, 100G and 100H shown in FIGS. 19(A) and (B) and FIGS. 20(A) and (B) respectively, the detected portion 105A is positioned on the center in the primary scanning direction of the set portion 102 (to which the trays 100E and 10OF correspond) or the center in the secondary scanning direction (to which the trays 100G and 100H correspond).

In case of the trays 100E and 100F in which the detected portion 105A is positioned on the center in the primary scanning direction of the set portion 102, accordingly, a distance between a coordinate $x_c$ in an x direction of a center c and the first detected line 108A and third detected line 108C (see FIG. 6) is reduced. Consequently, it is possible to prevent a deterioration in precision in the detection of the coordinate $x_c$ in the x direction of the center c.

In case of the trays 100G and 100H in which the detected portion 105A is positioned on the center in the secondary scanning direction of the set portion 102, moreover, a distance between a coordinate $y_c$ in a y direction of the center c and the second detected line 108B and fourth detected line 108D is reduced. Consequently, it is possible to prevent a deterioration in precision in the detection of the coordinate $y_c$ in the y direction of the center c.

While the description has been given to the example in which the invention is applied to the ink jet printer in the embodiments, the invention can also be applied to general liquid ejecting apparatuses.

The liquid ejecting apparatus is not restricted to recording apparatuses such as a printer, a copying machine and a facsimile in which a recording head of an ink jet type is used and an ink is discharged from the recording head to carry out recording to a medium but includes an apparatus for ejecting a liquid corresponding to uses from a liquid ejecting head corresponding to the recording head of an ink jet type onto a medium to be ejected corresponding to the medium in place of the ink and sticking the liquid to the medium to be ejected.

Examples of the liquid ejecting head include a coloring agent ejecting head to be used for manufacturing a color filter of a liquid crystal display, an electrode material (conducting paste) ejecting head to be used for forming an electrode of an organic EL display or a surface emitting display (FED), and furthermore, a bioorganism ejecting head to be used for manufacturing a biochip and a sample ejecting head to be a precision pipette in addition to the recording head.

What is claimed is:

1. A tray, adapted to be loaded in a recording apparatus which comprises a transport roller transporting a medium in a first direction, a recording head moved in a second direction orthogonal to the first direction to record information on the medium, and a sensor, the tray comprising:

a tray body, adapted to be transported in the first direction by the transport roller to a region opposing to the recording head;

a set portion, adapted such that the medium is placed thereon;

a first boundary line, defining two regions having different reflectivities and orthogonal to the second direction, the first boundary line being adapted to be detected by the sensor to provide a first reference position relative to the second direction; and a second boundary line, defining two regions having different reflectivities and orthogonal to the first direction, the second boundary line being adapted to be detected by the sensor to provide a second reference position relative to the first direction.

2. The tray according to claim 1, further comprising a fitting portion adapted to be fitted in a fitting hole formed in the medium, wherein the fitting portion is provided with the first boundary line and the second boundary line.

3. The tray according to claim 2, wherein the set portion has a symmetrical shape relative to the first and second directions, and the fitting portion is provided in a central position of the set portion in the first and second directions.

4. The tray according to claim 1, wherein each of the first and second boundary lines is a side constituting one plane figure.

5. The tray according to claim 4, wherein the plane figure is a right triangle.

6. The tray according to claim 4, further comprising a third boundary line, defining two regions having different reflectivities and orthogonal to the second direction, the third boundary line being adapted to be detected by the sensor to provide a third reference position relative to the second direction.

7. The tray according to claim 6, further comprising a fourth boundary line, defining two regions having different reflectivities and orthogonal to the first direction, the fourth boundary line being adapted to be detected by the sensor to provide a fourth reference position relative to the first direction.

8. The tray according to claim 6, wherein the plane figure is a square.

9. The tray according to claim 1, wherein the set portion has a circular shape adapted such that a disk-shaped member is placed thereon as the medium, and the first and second boundary lines are disposed at an outside of the set portion and within at least one of a region defined by two lines extending in the first direction and tangent to the circular set portion and a region defined by two lines extending in the second direction and tangent to the circular set portion.

10. The tray according to claim 9, wherein the first and second boundary lines are disposed so as to avoid lines extending in the first and second directions while crossing a central position of the set portion.

11. The tray according to claim 9, wherein the first and second boundary lines are disposed on lines extending in the first and second directions while crossing a central position of the set portion.

* * * * *

UNITED STATES PATENT AND TRADEMARK OFFICE

CERTIFICATE OF CORRECTION

PATENT NO. : 7,600,866 B2
APPLICATION NO. : 11/396171
DATED : October 13, 2009
INVENTOR(S) : Takeshita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 860 days.

Signed and Sealed this

Fifth Day of October, 2010

David J. Kappos

David J. Kappos
*Director of the United States Patent and Trademark Office*